US007558034B2

(12) United States Patent
Bonasia et al.

(10) Patent No.: US 7,558,034 B2
(45) Date of Patent: Jul. 7, 2009

(54) BI-DIRECTIONAL GROUND FAULT CIRCUIT INTERRUPTER

(75) Inventors: Gaetano Bonasia, Bronx, NY (US); Benjamin Moadel, New York, NY (US); James A. Porter, Farmingdale, NY (US); Steve Campolo, Malverne, NY (US)

(73) Assignee: Leviton Manufacturing Company, Inc., Little Neck, NY (US)

( * ) Notice: Subject to any disclaimer, the term of this patent is extended or adjusted under 35 U.S.C. 154(b) by 0 days.

(21) Appl. No.: 11/750,286

(22) Filed: May 17, 2007

(65) Prior Publication Data

US 2007/0274012 A1 Nov. 29, 2007

Related U.S. Application Data

(60) Provisional application No. 60/747,584, filed on May 18, 2006.

(51) Int. Cl.
*H02H 3/00* (2006.01)
*H02H 9/08* (2006.01)

(52) U.S. Cl. ..... 361/42; 335/6; 335/7; 335/8; 335/9; 335/10; 335/11; 335/12; 335/13; 335/14; 335/18; 361/43; 361/44; 361/45; 361/51

(58) Field of Classification Search ..... 335/6–18; 361/42–51
See application file for complete search history.

(56) References Cited

U.S. PATENT DOCUMENTS 3,668,471 A 6/1972 Ambler et al.
4,568,997 A 2/1986 Bienwald et al.
5,418,678 A 5/1995 McDonald
5,541,800 A 7/1996 Misencik
5,661,623 A 8/1997 McDonald et al.
5,706,155 A 1/1998 Neiger et al.
5,729,417 A * 3/1998 Neiger et al. ..... 361/45
6,052,265 A 4/2000 Zaretsky et al.
6,246,558 B1 6/2001 DiSalvo et al.
6,417,581 B2 7/2002 Hall et al.
6,437,700 B1 8/2002 Herzfeld et al.
6,522,510 B1 2/2003 Finlay et al.
6,621,388 B1 9/2003 Macbeth
6,657,839 B2 12/2003 de Oliveira
6,693,779 B2 2/2004 DiSalvo
6,724,590 B1 4/2004 Radosavljevic et al.
6,771,152 B2 8/2004 Germain et al.
6,807,035 B1 10/2004 Baldwin et al.

(Continued)

FOREIGN PATENT DOCUMENTS

WO WO2004070901 8/2004
WO WO2007137180 11/2007

OTHER PUBLICATIONS

International Search Report for PCT/US07/69277; Jun. 13, 2008.

*Primary Examiner*—Elvin G Enad
*Assistant Examiner*—Mohamad A Musleh
(74) *Attorney, Agent, or Firm*—Collard & Roe, P.C.

(57) ABSTRACT

The present invention relates to a family of resettable circuit interrupting devices that eliminates the need to rewire a resettable circuit interrupting device after it is installed and powered up to correct for a reverse wiring conditions.

17 Claims, 19 Drawing Sheets

U.S. PATENT DOCUMENTS 6,807,036 B2 10/2004 Baldwin
6,920,025 B2 7/2005 Nelson
6,937,452 B2 * 8/2005 Chan et al. ..... 361/42
7,187,526 B2 3/2007 DiSalvo
7,196,886 B2 * 3/2007 Chan et al. ..... 361/42
2005/0030685 A1 * 2/2005 DiSalvo ..... 361/42
2005/0280962 A1 * 12/2005 Chan et al. ..... 361/42
2006/0268472 A1 11/2006 Winch
2007/0268635 A1 * 11/2007 Bonasia et al. ..... 361/42
2007/0274012 A1 11/2007 Bonasia et al.

* cited by examiner

BI-DIRECTIONAL GROUND FAULT CIRCUIT INTERRUPTER

This application claims priority pursuant to 35 U.S.C. 119(e) from U.S. Provisional Application having Application No. 60/747,584 filed May 18, 2006.

BACKGROUND

1. Field of the Invention

The present application is directed to a family of resettable circuit interrupting devices and systems that comprises ground fault circuit interrupters (GFCI's), arc fault circuit interrupters (AFCI's), immersion detection circuit interrupters (IDCI's), appliance leakage circuit interrupters (ALCI's), equipment leakage circuit interrupters (ELCI's), circuit breakers, contactors, latching relays and solenoid mechanisms. More particularly, the present application is directed to circuit interrupting devices that include a circuit interrupting portion that can break electrically conductive paths between a line side and a load side of the devices.

2. Description of the Related Art

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. A more detailed description of a GFCI device is provided in commonly owned U.S. Pat. No. 4,595,894, which is incorporated herein in its entirety by reference. Presently available GFCI devices, such as the device described in U.S. Pat. No. 4,595,894 (the '894 patent), use an electrically activated trip mechanism to mechanically break an electrical connection between the line side and the load side. Such devices are resettable after they are tripped by, for example, the detection of a ground fault. In the device discussed in the '894 patent, the trip mechanism used to cause the mechanical breaking of the circuit (i.e., the conductive path between the line and load sides) includes a solenoid (or trip coil). A test button is used to test the trip mechanism, circuitry is used to sense faults, and a reset button is used to reset the electrical connection between line and load sides.

However, instances may arise where an abnormal condition caused by, for example, a lightning strike which may result not only in a surge of electricity at the device and a tripping of the device, but also a disabling of the trip mechanism used to cause the mechanical breaking of the circuit. This can occur without the knowledge of the user. Under such circumstances an unknowing user, having a GFCI which has tripped, may press the reset button which, in turn, will cause the device with an inoperative trip mechanism to be reset without the ground fault protection being available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, current GFCI devices, which have tripped, may be reset even though the open neutral condition may remain.

Commonly owned U.S. Pat. No. 6,040,967 which is incorporated herein in its entirety by reference, describes a family of resettable circuit interrupting devices capable of locking out the reset portion of the device if the circuit interrupting portion is non-operational or if an open neutral condition exists.

Some of the circuit interrupting devices described above have a user accessible load side connection in addition to the line and load side connections. The user accessible load side connection includes one or more connection points where a user can externally connect to the electrical power supplied from the line side. The load side connection and user accessible load side connection are typically electrically connected together. An example of such a circuit interrupting device is a GFCI receptacle, where the line and load side connections are binding screws and the user accessible load side connection is a typical two or three hole receptacle used in power outlets for connection to electrical devices typically using a two-prong or three-prong male plug. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load connection. This is known as reverse wiring. In the event the circuit interrupting device is reverse wired, in the prior art devices, fault protection to the user accessible load connection may be eliminated, even if fault protection to the load side connection remains. Further, because fault protection is eliminated the user accessible terminals (i.e., three hole or two hole receptacles) will have electrical power making a user think that the device is operating properly when in fact it is not. Additionally, some circuit interrupting devices may preclude power by not allowing reset when it is reverse wired. In this instance, the user or installer may erroneously believe that the device is defective.

Therefore, there exists a need for a device which is correctly wired regardless of which wires, the load wires or the line wires are connected to the line side connection of the device. Thus, there is a need for a device which cannot be reversed wired.

SUMMARY OF THE INVENTION

The present invention relates to a family of resettable circuit interrupting devices that avoid reverse wiring conditions by sensing which terminals of the circuit interrupting device, the line terminals or the load terminals, are connected to wires having input power, and latching those terminals to the line side connection of the device and the other terminals to the load side connection of the device. The devices have a reset lockout mechanism that prevents them from being reset when they are not operating properly. When the devices are not reset, no power is available to any user accessible receptacle and/or plug located on the face of the devices. Each of the devices of the present invention has at least one pair of line terminals, one pair of load terminals and one pair of face terminals. The line terminals are capable of being electrically connected to a source of power or to a load. The load terminals are capable of being electrically connected to a load or to a source of power. The face terminals are electrically connected to user accessible plugs and/or receptacles located on the face of a device. The line, load and face terminals are electrically isolated from each other. The devices of the present invention are manufactured and shipped in a tripped condition, i.e., no electrical connection between line terminals and load terminals and no electrical connection between the load terminals and face terminals. Thus, in the tripped condition, at least three sets of terminals are electrically isolated from each other.

Each of the pairs of terminals has a phase terminals and a neutral terminal. A phase conducting path is created when the corresponding phase terminals are connected to each other. Similarly, a neutral conducting path is created when the corresponding neutral terminals are connected to each other. Preferably, the phase conductive path includes one or more switch devices capable of opening to cause electrical discontinuity in the phase conductive path and of closing to reestablish electrical continuity in the phase conductive paths. Also, the neutral conductive path includes one or more switch devices capable of opening to cause electrical discontinuity in the neutral conductive path and of closing to reestablish electrical continuity in the neutral conductive paths.

The devices of the present invention each further have two pairs of movable contacts, one pair being electrically connected to the neutral terminals and the other pair being connected to the phase terminals. The movable contacts electrically connect the line terminals to the load and face terminals when the devices are reset thus bringing power to the face of the devices. The movable contacts are mechanically biased away from the load and face terminals.

In one embodiment, the circuit interrupting device comprises a housing within which the line terminals, the movable contacts, the load terminals and the face terminals are at least partially disposed. The circuit interrupting device also comprises a circuit interrupting portion that is disposed within the housing and configured to cause electrical discontinuity between the terminals upon the occurrence of a predetermined condition. The circuit interrupting device further comprises a trip portion, a reset portion and a sensing circuit.

One embodiment for the circuit interrupting device uses an electromechanical circuit interrupting portion that causes electrical discontinuity between the line, load and face terminals. The reset lockout mechanism prevents the reestablishing of electrical continuity between the line, load and face terminals unless the circuit interrupting portion is operating properly. The reset portion allows the device to be reset causing electrical continuity between the line terminals and the load terminals and electrical continuity between the line terminals and the face terminals; i.e., device in set or reset mode. Also, there is electrical continuity between the load terminals and the face terminals when the device is reset. Thus the reset portion establishes electrical continuity between the line, load and face terminals. The electromechanical circuit interrupting portion comprises a latch plate and lifter assembly, a coil and plunger assembly, a mechanical switch assembly, the movable contacts and the sensing circuit.

The reset portion can comprise a reset pin connected to a reset button; the button and reset pin are mechanically biased and the reset pin has a flange (e.g., circular flange or disk) which extends radially from an end portion of the reset pin for interference with the latch plate and lifter assembly when the reset button is depressed while the device is in the tripped condition. The interfered latch plate and lifter assembly engages the mechanical switch assembly which triggers the sensing circuit. If the circuit interrupting portion is operating properly, the triggered sensing circuit causes a coil assembly coupled to the sensing circuitry to be energized. The energized coil assembly, which has a movable plunger located therein, causes the movable plunger to engage the latch plate allowing the end portion of the reset pin and the flange to go through momentarily aligned openings in the latch plate and lifter assembly. The openings then become misaligned trapping the flange and the end portion of the reset pin underneath the lifter. The flange now interferes with the latch plate and lifter assembly from underneath the lifter. The biasing of the reset pin is such that the reset pin tends to move away from the latch and lifter assembly when the button is released after having been depressed. Upon release of the reset button, the biasing of the reset pin, in concert with its interfering flange, allows it to lift the latch plate and lifter assembly. Thus, the lifter portion of the latch plate and lifter assembly engages the movable contacts causing the contacts to electrically connect the line, load and face terminals to each other thus putting the device in a set or reset condition. If the circuit interrupting portion is not operating properly the plunger of the coil assembly does not engage the latch plate and lifter assembly thus preventing the circuit interrupting device from being reset.

The sensing circuit comprises various electrical and electronic components for detecting the occurrence of a ground fault, an arc fault, a leakage current condition, etc., herein after referred to as a predetermined condition. The sensing circuitry is coupled to the electromechanical circuit interrupting portion. Upon detection of a predetermined condition the sensing circuitry activates the electromechanical circuit interrupter causing the device to be in the tripped condition.

The tripped condition is obtained by activating the trip portion of the circuit interrupting device. The trip portion of the circuit interrupting device is disposed at least partially within the housing and is configured to cause electrical discontinuity in the phase and/or neutral conductive paths. The tripped condition can also occur when the device detects a predetermined condition (e.g., ground fault) while in the reset mode. In one embodiment, the trip portion comprises a test button connected to a trip pin having a cam or angled portion at its end which cam or angled portion can engage the latch plate when the device has been reset. The trip pin and the test button are mechanically biased such that the trip pin tends to move away from the latch and lifter assembly when the test button is first depressed and then released. The trip portion when activated (i.e., test button is depressed), while the device is in the reset mode, causes the cam portion of the trip pin to engage the latch plate to momentarily align the lifter and latch plate openings; this allows the end portion and flange of the reset pin to be released from underneath the lifter and thus no longer interferes with the lifter and latch plate assembly. As a result the lifter and latch plate no longer lift the movable contacts and the biasing of the movable contacts causes them to move away from the load and face terminals disconnecting the line, load and face terminals from each other thus putting the device in the tripped condition.

BRIEF DESCRIPTION OF THE DRAWINGS

Preferred embodiments of the present application are described herein with reference to the drawings, in which similar elements are given similar reference characters, wherein.

DETAILED DESCRIPTION

Figure 1:
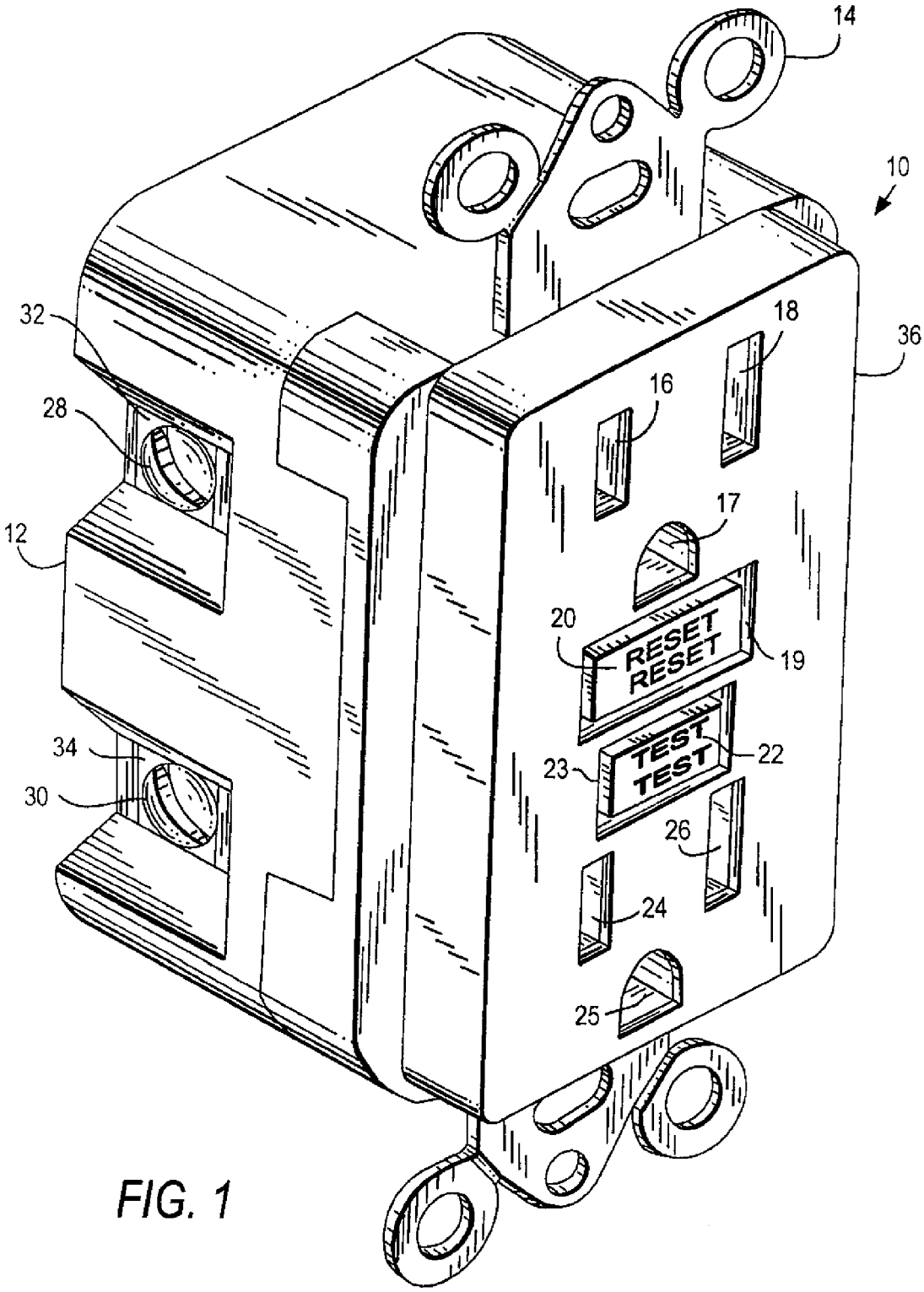
FIG. 1 is a perspective view of one embodiment of a ground fault circuit interrupting device according to the present application.

The present application contemplates various types of circuit interrupting devices that have at least one conductive path. The conductive path is typically divided between a line side that connects to electrical power, a load side that connects to one or more loads and a user side that connects to user accessible plugs or receptacles. As noted, the various devices in the family of resettable circuit interrupting devices can comprise: ground fault circuit interrupters (GFCI's), arc fault circuit interrupters (AFCI's), immersion detection circuit interrupters (IDCI's), appliance leakage circuit interrupters (ALCI's) and equipment leakage circuit interrupters (ELCI's).

For the purpose of the present application, the structure or mechanisms used in the circuit interrupting devices, shown in the drawings and described below, are incorporated into a GFCI device suitable for installation in a single-gang electrical junction box used in, for example, a residential electrical wiring system. However, the mechanisms according to the present application can be included in any of the various devices in the family of resettable circuit interrupting devices. Further, more generally the circuit interrupting device of the present invention can be implemented as any device having at least a first, second, and third electrical conductor each of which is at least partially disposed in a housing. The electrical conductors are electrically isolated from each other with the first conductor capable of being connected to electrical power, the second conductor capable of being connected to one or more loads and the third conductor configured to be accessible to users. At least one pair of contacts commonly referred to as double pole single throw contacts, one end of which is connected to the source of power and the first conductor, is able to connect the first, second and third electrical conductors to each other and disconnect said conductors from each other when a fault or predetermined condition is detected.

More specifically, however, the circuit interrupting devices described herein have at least three pairs of electrically isolated terminals: at least one pair of line terminals, at least one pair of load terminals and at least one pair of user or face terminals. The at least one pair of line terminals permits electrical power (e.g., alternating current (AC)) to be connected to the device and the at least one pair of load terminals permits external conductors or appliances to be connected to the device. These connections may be, for example, electrical fastening devices that secure or connect external conductors to the circuit interrupting device, as well as conduct electricity. Examples of such connections include binding screws, lugs, terminals and external plug connections. The at least one face or user terminal, which typically is implemented using two-prong or three-prong receptacles, allows users to electrically connect electrical devices to the GFCI device typically via the two-prong or three-prong male plugs that mate with the receptacles.

The above-described features can be incorporated in any resettable circuit interrupting device, but for the sake of explanation the description to follow is directed to a GFCI device.

In one embodiment, the GFCI device has a circuit interrupting portion, a reset portion, a reset lockout mechanism and a switching latching portion. The GFCI device also has a mechanical trip portion. The GFCI device further has a pair of double pole single throw contacts that, when engaged, connect the line terminals to load and face terminals. When the double pole single throw contacts are not engaged, the line, load and face terminals are electrically isolated from each other. Because the face terminals are electrically isolated from the load and line terminals, there will be no power at the face terminals. When the double pole single throw contacts are not engaged and thus the line, load and face terminals are electrically isolated from each other, the device is said to be in a tripped condition. It is here noted that, in place of the double pole single throw contacts, movable bridge contacts can be used.

The circuit interrupting and reset portions described herein preferably use electro-mechanical components to break (open) and make (close) one or more conductive paths between the line and load terminals of the device and also between the line and face terminals. However, electrical components, such as solid state switches and supporting circuitry, may be used to open and close the conductive paths.

Generally, the circuit interrupting portion is used to automatically break electrical continuity in one or more conductive paths (i.e., open the conductive path) between the line and load terminals upon the detection of a fault, which in the embodiment described is a ground fault. Electrical continuity is also broken between the line and face terminals. The reset portion is used to close the open conductive paths.

In this configuration, the operation of the reset and reset lockout portions is in conjunction with the operation of the circuit interrupting portion, so that electrical continuity in open conductive paths cannot be reset if the circuit interrupting portion is non-operational, and/or an open neutral condition exists. When the circuit interrupting portion is non-operational—meaning that any one or more of its components is not operating properly—the device cannot be reset. The mechanical trip portion is able to break electrical continuity between the line, load and face terminals independently of the operation of the circuit interrupting portion. Thus, in the event the circuit interrupting portion is not operating properly, the device can still be tripped.

Turning now to FIG. 1, the GFCI device has a housing 12 to which a face or cover portion 36 is removably secured. The face portion 36 has entry ports 16, 18, 24 and 26 aligned with receptacles for receiving normal or polarized prongs of a male plug of the type normally found at the end of a household device electrical cord (not shown), as well as ground-prong-receiving openings 17 and 25 to accommodate three-wire plugs. The GFCI device also includes a mounting strap 14 used to fasten the device to a device box.

A test button 22 extends through opening 23 in the face portion 36 of the housing 12. The test button is used to set the device 10 to a tripped condition. The circuit interrupting portion, to be described in more detail below, is used to break electrical continuity in one or more conductive paths between the line and load side of the device. A reset button 20 forming a part of the reset portion extends through opening 19 in the face portion 36 of the housing 12. The reset button is used to activate a reset operation, which reestablishes electrical continuity in the open conductive paths.

Still referring to FIG. 1, electrical connections to existing household electrical wiring are made via binding screws 28 and 30 where, for example, screw 30 is an input (or line) phase connection, and screw 28 is an output (or load) phase connection. Screws 28 and 30 are fastened (via a threaded arrangement) to terminals 32 and 34 respectively. However, as is here disclosed the GFCI device includes a switching latching circuit which permits either terminal 30 or 28 to be connected to the line and, therefore, the screw 30 can be an output phase connection and screw 28 an input phase or line connection. Terminals 32 and 34 are one half of terminal pairs. Thus, two additional binding screws and terminals (not shown) are located on the opposite side of the device 10. These additional binding screws provide line and load neutral connections, respectively. It should also be noted that the binding screws and terminals are exemplary of the types of wiring terminals that can be used to provide the electrical connections. Examples of other types of wiring terminals include set screws, pressure clamps, pressure plates, push-in type connections, pigtails and quick-connect tabs. The face terminals are implemented as receptacles configured to mate with male plugs. A detailed depiction of the face terminals is shown in FIG. 2.

Figure 2:
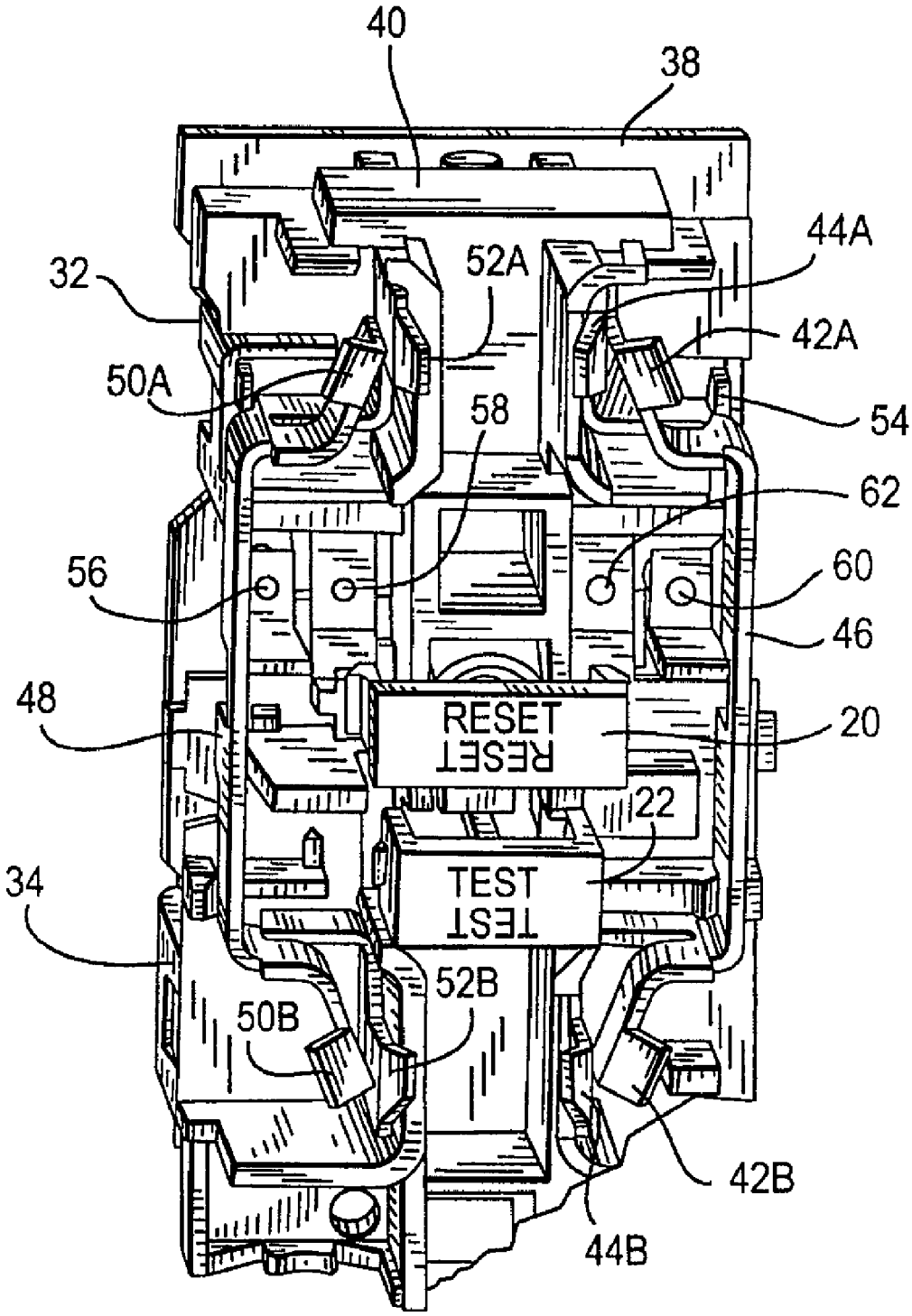
FIG. 2 is top view of a portion of the GFCI device shown in FIG. 1, with the face portion removed.

Referring to FIG. 2, a top view of the GFCI device (without face portion 36 and strap 14) is shown. An internal housing structure 40 provides the platform on which the components of the GFCI device are positioned. Reset button 20 and test button 22 are mounted on housing structure 40. Housing structure 40 is mounted on printed circuit board 38. The receptacle aligned to opening 16 of face portion 36 is made from extensions 50A and 52A of frame 48. Frame 48 is made from an electricity conducting material from which the receptacles aligned with openings 16 and 24 are formed. The receptacle aligned with opening 24 of face portion 36 is constructed from extensions 50B and 52B of frame 48. Also, frame 48 has a flange the end of which has electricity conducting contact 56 attached thereto. Frame 46 is an electricity conducting material from which receptacles aligned with openings 18 and 26 are formed. The receptacle aligned with opening 18 of frame portion 36 is constructed with frame extensions 42A and 44A. The receptacle aligned with opening 26 of face portion 36 is constructed with extensions 42B and 44B. Frame 46 has a flange the end of which has electricity conducting contact 60 attached thereto. Therefore, frames 46 and 48 form the face terminals implemented as receptacles aligned to openings 16, 18, 24 and 26 of face portion 36 of GFCI 10 (see FIG. 1). Load terminal 32 and line terminal 34 are also mounted on internal housing structure 40. Load terminal 32 has an extension the end of which electricity conducting load contact 58 is attached. Similarly, load terminal 54 has an extension to which electricity conducting contact 62 is attached. The line, load and face terminals are electrically isolated from each other and are electrically connected to each other by a pair of movable bridges or single throw double pole switch contacts. The relationship between the line, load and face terminals and how they are connected to each other is shown in FIG. 3.

Figure 3:
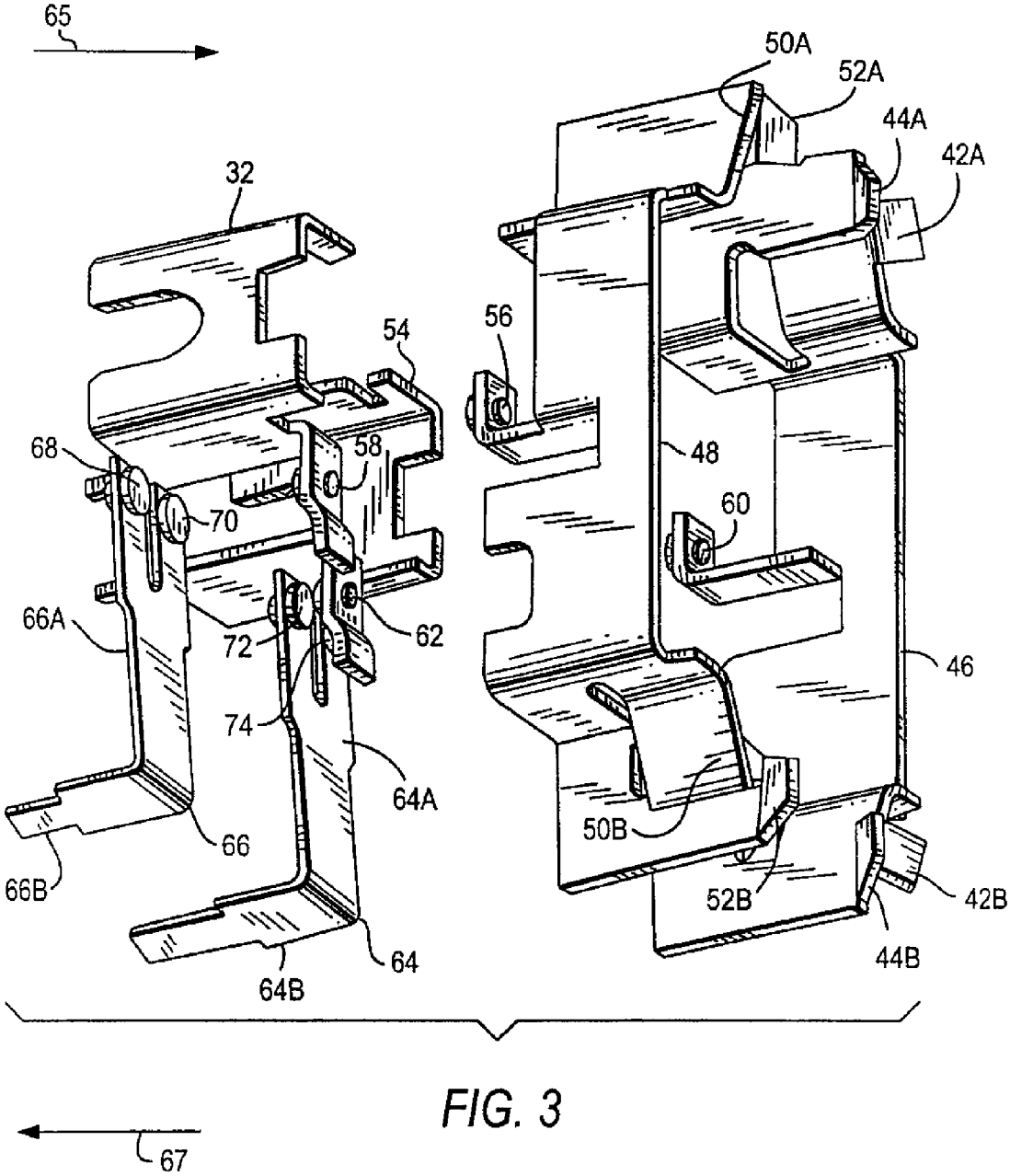
FIG. 3 is an exploded perspective view of the face terminal internal frames, the load terminals and the movable bridges.

Referring now to FIG. 3, there is shown the positioning of the face and load terminals with respect to each other and their interaction with the movable bridges (64, 66). As noted above, in place of the movable bridges, single throw double pole switch contacts can be used. Although the line terminals are not shown, it is understood that they are electrically connected to one end of the movable bridges. The movable bridges (64, 66) are generally electrical conductors that are configured and positioned to connect at least the line terminals to the load terminals. In particular movable bridge 66 has bent portion 66B and connecting portion 66A. Bent portion 66B is electrically connected to line terminal 34 (not shown). Similarly, movable bridge 64 has bent portion 64B and connecting portion 64A. Bent portion 64B is electrically connected to the other line terminal (not shown); the other line terminal being located on the side opposite that of line terminal 34. Connecting portion 66A of movable bridge 66 has two fingers each having a bridge contact (68, 70) attached to its end. Connecting portion 64A of movable bridge 64 also has two fingers each of which has a bridge contact (72, 74) attached to its end. The bridge contacts (68, 70, 72 and 74) are made from relatively highly conductive material. Also, face terminal contacts 56 and 60 are made from relatively highly conductive material. Further, the load terminal contacts 58 and 62 are made from relatively highly conductive material. The movable bridges are preferably made from flexible metal that can be bent when subjected to mechanical forces. The connecting portions (64A, 66A) of the movable bridges are mechanically biased downward or in the general direction shown by arrow 67. When the GFCI device is reset the connecting portions of the movable bridges are caused to move in the direction shown by arrow 65 and engage the load and face terminals thus connecting the line, load and face terminals to each other. In particular connecting portion 66A of movable bridge 66 is bent upward (direction shown by arrow 65) to allow contacts 68 and 70 to engage contacts 56 of frame 48 and contact 58 of load terminal 32 respectively. Similarly, connecting portion 64A of movable bridge 64 is bent upward (direction shown by arrow 65) to allow contacts 72 and 74 to engage contact 62 of load terminal 54 and contact 60 of frame 46 respectively. The connecting portions of the movable bridges are bent upwards by a latch/lifter assembly positioned underneath the connecting portions where this assembly moves in an upward direction (direction shown by arrow 65) when the GFCI is reset as will be discussed herein below with respect to FIG. 14. It should be noted that the contacts of a movable bridge engaging a contact of a load or face terminals occurs when electric current flows between the contacts; this is done by having the contacts touch each other. Some of the components that cause the connecting portions of the movable bridges to move upward are shown in FIG. 4.

Figure 4:
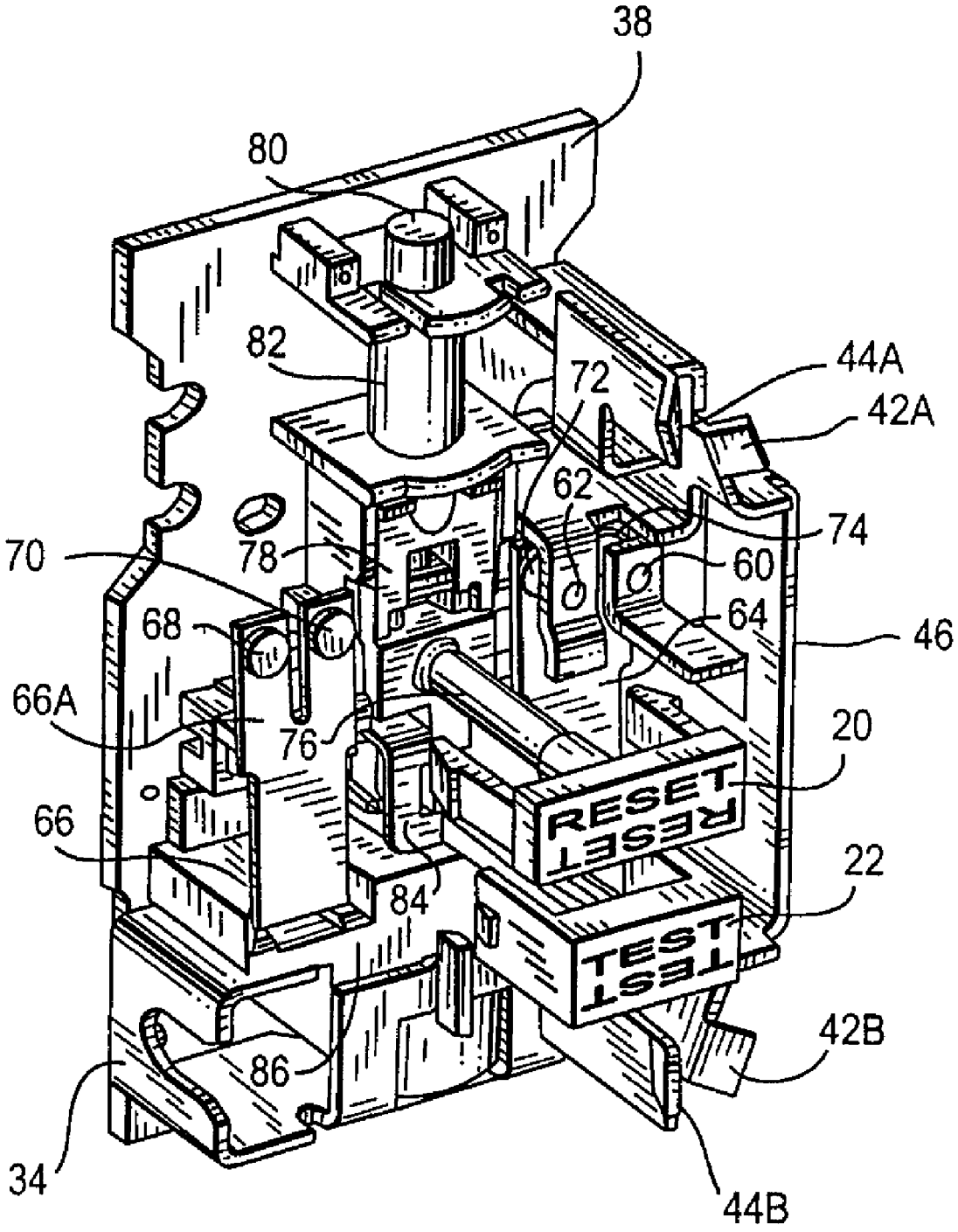
FIG. 4 is a perspective view of the arrangement of some of the components of the circuit interrupting portion of the device of the present invention.

Referring now to FIG. 4, there is shown mounted on printed circuit board 38 a coil plunger combination comprising bobbin 82 having a cavity in which elongated cylindrical plunger 80 is slidably disposed. For clarity of illustration frame 48 and load terminal 32 are not shown. One end of plunger 80 is shown extending outside of the bobbin cavity. The other end of plunger 80 (not shown) is coupled to or engages a spring that provides the proper force for pushing a portion of the plunger outside of the bobbin cavity after the plunger has been pulled into the cavity due to a resulting magnetic force when the coil is energized. Electrical wire (not shown) is wound around bobbin 82 to form the coil. For clarity of illustration the wire wound around bobbin 82 is not shown. A lifter 78 and latch 84 assembly is shown where the lifter 78 is positioned underneath the movable bridges. The movable bridges 66 and 64 are secured with mounting brackets 86 (only one is shown) which is also used to secure line terminal 34 and the other line terminal (not shown) to the GFCI device. It is understood that the other mounting bracket 86 used to secure movable bridge 64 is positioned directly opposite the shown mounting bracket. The reset button 20 has a reset pin 76 that engages lifter 78 and latch 84 assembly as will be shown below.

Figure 5:
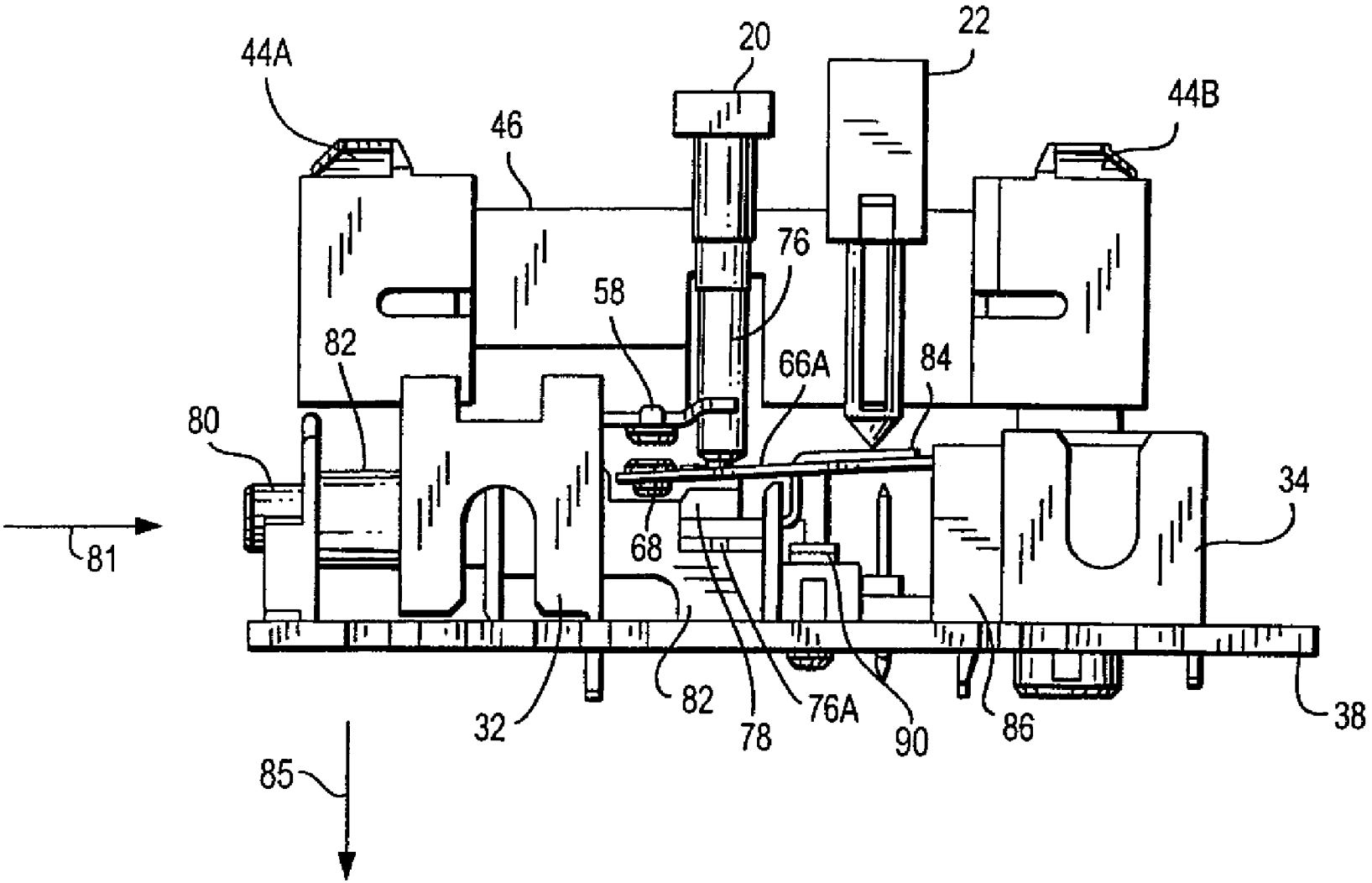
FIG. 5 is a side view of FIG. 4.

Referring now to FIG. 5, there is shown a side view of FIG. 4. When the coil is energized, plunger 80 is pulled into the coil in the direction shown by arrow 81. Connecting portion 66A of movable bridge 66 is shown biased downward (in the direction shown by arrow 85). Although not shown, connecting portion of movable bridge 64 is similarly biased. Also part of a mechanical switch—test arm 90—is shown positioned under a portion of the lifter 78. It should be noted that because frame 48 is not shown, face terminal contact 56 is also not shown.

Figure 6:
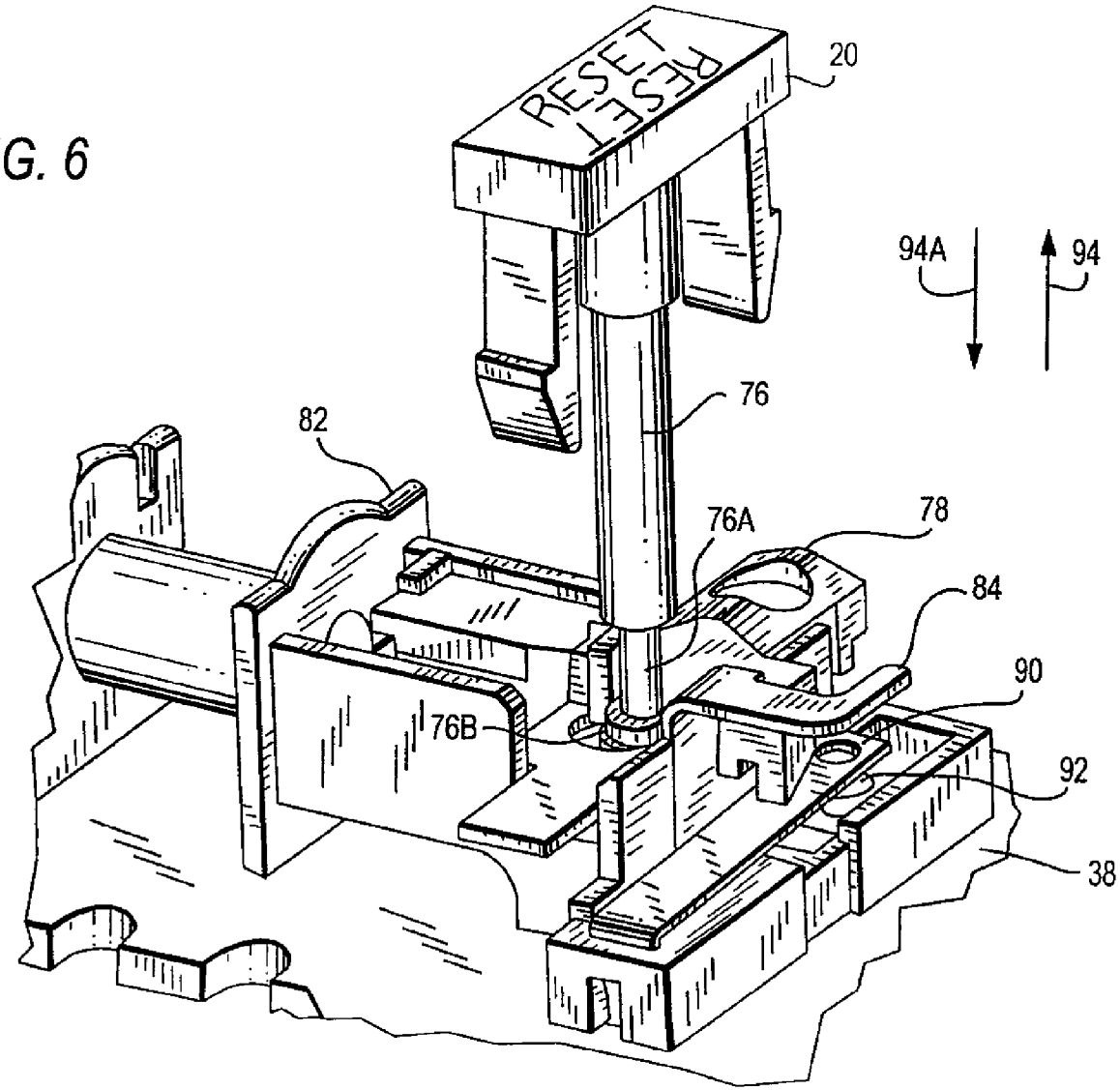
FIG. 6 is a perspective view of the reset portion of the present invention.

Referring now to FIG. 6, there is shown the positioning of the lifter 78, latch 84 assembly relative to the bobbin 82, the reset button 20 and reset pin 76. Note that the reset pin has a lower portion 76A and a disk shaped flange 76B. It should be noted that the flange 76B can be any shape, the disk shaped flange shown here is one particular embodiment of the type of flange that can be used. The lower portion 76A of the reset pin and flange 76B are positioned so as to extend through aligned openings of the latch 84 and lifter 78. The mechanical switch assembly is also shown positioned underneath a portion of the lifter 78. The mechanical switch assembly comprises test arm 90 and test pin 92 used to cause a trip condition to occur. The reset button 20 and reset pin 76 are biased with a spring coil (not shown) in the upward direction (direction shown by arrow 94). Test arm 90 of the mechanical switch is also biased upward. When the test arm 90 is pressed downward (direction shown by arrow 94A), it will tend to move upward (direction shown by arrow 94) to its original position when released. Similarly, when reset button 20 is depressed (in the direction shown by arrow 94A), it will return to its original position by moving in the direction shown by arrow 94. Latch plate 84 and lifter 78 assembly are mounted on top of bobbin 82. Only a portion of lifter 78 is shown so as to illustrate how lifter 78 engages test arm 90 and how latch plate 84 engages lifter 78. The specific relationship between latch plate 84 and lifter 78 is shown in FIG. 7.

Figure 7:
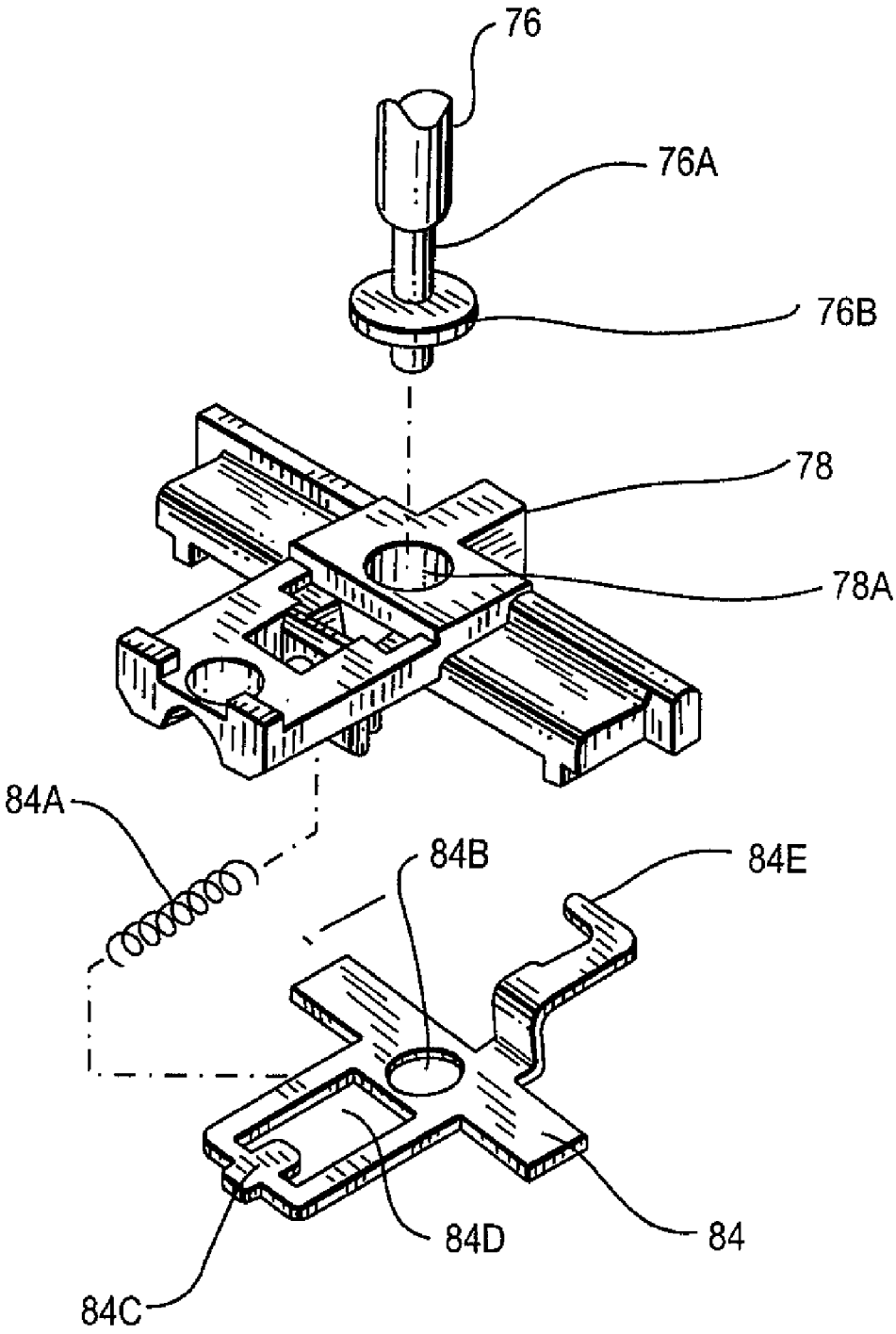
FIG. 7 is an exploded perspective view of the lifter/latch assembly of the circuit interrupting device of the present invention.

Referring now to FIG. 7, there is shown how the latch plate 84 is spring urged and slidably mounted to lifter 78. Latch plate 84 has an opening 84B and another opening 84D within which spring coil 84A is positioned. Latch plate stub 84C is use to receive one end of spring coil 84A and the other end of spring coil 84A engages with a detent portion of lifter 78. Latch plate 84 has a hook portion 84E used to engage test button 22 as will be discussed below with respect to FIG. 15. Although not part of the latch plate/lifter assembly, reset pin 76, with lower portion 76A and flange 76B is designed to extend through opening 78A of lifter 78 and opening 84B of latch plate 84 when the two openings are aligned to each other. The two openings become aligned with each other when the plunger 80 of the coil plunger assembly engages latch plate 84 as will be discussed herein. The plunger is caused to be pulled into the cavity of the bobbin 82 when the coil is energized by a sensing circuit when the circuit detects a fault or another predetermined condition. In the embodiment being discussed, the predetermined condition detected is a ground fault. The predetermined condition can be any type of fault such as an arc fault, equipment fault, appliance leakage fault or an immersion detection fault. Generally a fault is an indication that the circuit interrupting device has detected a dangerous condition and has or intends to disconnect power from any loads connected to the device via the load terminals and/or the face terminals. The sensing circuit and switching latching circuit is shown in FIG. 8.

Figure 8:
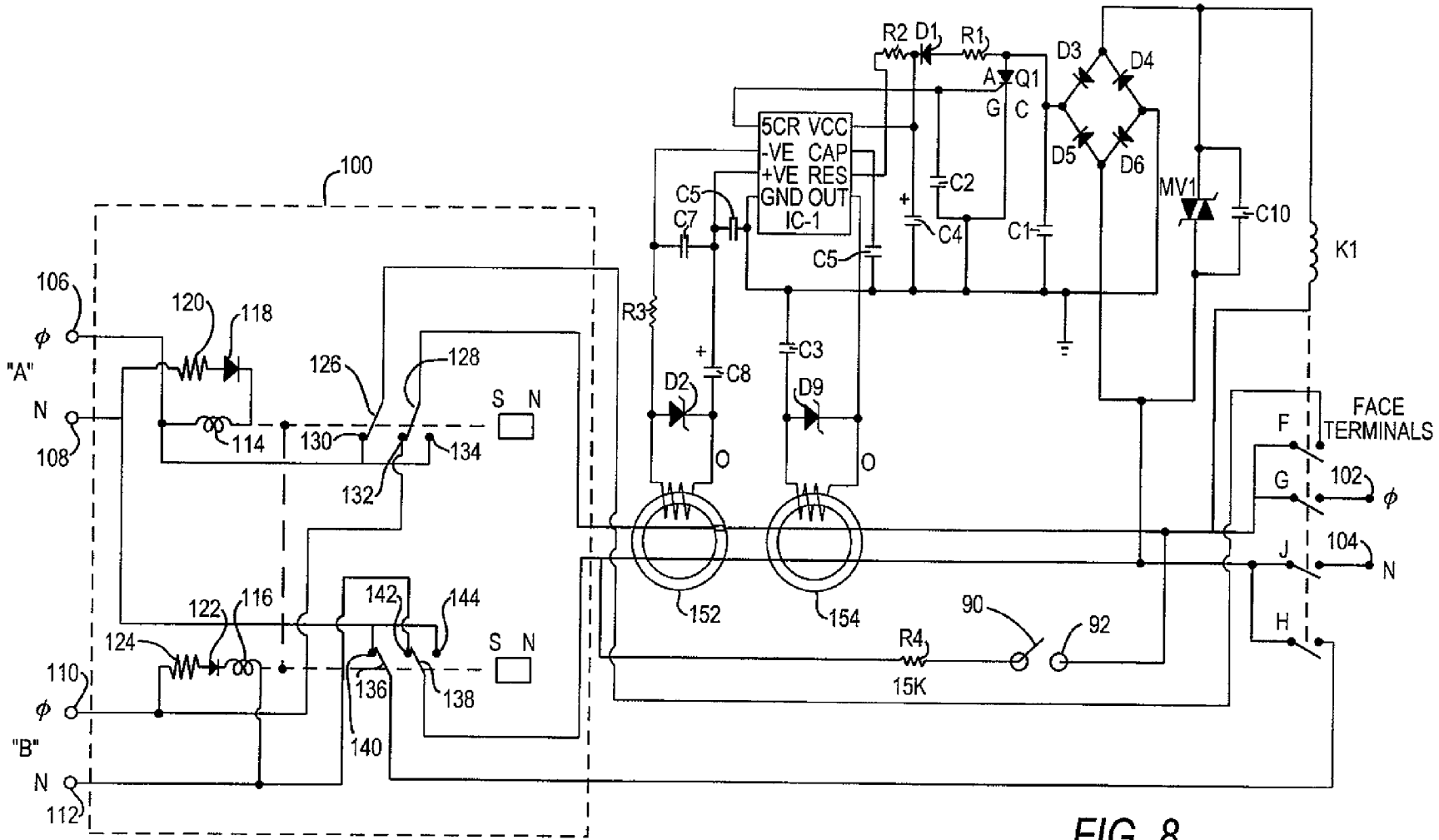
FIG. 8 is a schematic diagram of the sensing circuit and switching latching circuit for avoiding a reverse wiring condition.

Referring now to FIG. 8, the sensing circuit comprising a differential transformer, a Ground/Neutral (G/N) transformer, an integrated circuit (IC-1) for detecting current and outputting a voltage once it detects a current, a full wave bridge rectifier (D3, D4, D5, and D6), a surge suppressor (MV1) for absorbing extreme electrical energy levels that may be present at the line terminals, various filtering coupling capacitors (C1 C9), a gated semiconductor device (Q1), a relay coil assembly (K1), various current limiting resistors (R1 R4) and a voltage limiting zener diode (D2). The mechanical switch comprising test arm 90 and test pin 92 is shown connected to the conductors of the line terminals in series with current limiting resistor R4. The double pole single throw switch contacts, F and G; and, J and H, which can also be bridge terminals, connect the line terminals to the face terminals and the load terminals. The double pole, single throw switch contacts, when open, electrically isolate the line, load and face terminals of the receptacle from each other and, when closed, electrically connect the line, load and face terminals to each other. With a GFCI, when a predetermined condition occurs, such as a ground fault, a difference in current amplitude is present between the two line terminals. This current difference is manifested as a net current which is detected by the differential transformer and is fed to integrated circuit IC-1. Integrated circuit IC-1 can be any one of integrated circuits typically used in ground fault circuits (e.g., LM-1851) manufactured National Semiconductor or other well known semiconductor manufacturers. In response to the current provided by the differential transformer, integrated circuit IC-1 generates a voltage on pin 1 which is connected to the gate of Q1 and turns Q1 on. A full wave bridge comprising diodes D3-D6 has a DC side connected to the anode of Q1. When Q1 is turned on, DC from the full wave bridge activates relay K1 which causes the contacts of the double pole single throw switches to remove power from the face and load terminals of the receptacle. Relay K1 has bobbin, coil and plunger components which are coupled to move the contacts of the double pole single throw switch. Diode D1 performs a rectification function for retaining the supply voltage to IC-1 when Q1 is turned on. The relay K1 can also be activated when mechanical switch 90 is closed which causes a current imbalance on the line terminal conductors that is detected by the differential transformer. The G/N transformer detects a remote ground voltage that may be present on one of the load terminal conductors and provides a current to IC-1 upon detection of this remote ground which again activates relay K1.

The sensing circuit engages a circuit interrupting portion of the GFCI device which causes the device to be tripped. Also, the sensing circuit allows the GFCI device to be reset after it has been tripped if the reset lockout has not been activated as discussed herein below. In the tripped condition the line terminals, load terminals and face terminals are electrically isolated from each other. The GFCI here disclosed is shipped in the tripped condition. The circuit interrupting portion comprises the coil and plunger (80) assembly, the latch plate (84) and lifter (78) assembly, and the mechanical switch assembly (90, 92).

With this invention, a switching latching circuit 100 is disclosed which prevents the GFCI being reversed wired, regardless of which screw terminals, the screw terminals for the line or the load, are connected to the line wires. With this invention, the wire connections to the two sets of screw terminals on the GFCI are now interchangeable. The line conductors, the conductors connected to a source of power can now be connected to either set of screw terminals on the GFCI and the load conductors can be connected to the other set of screw terminals. Regardless of how the line and load conductors are connected to the GFCI, the switching latching circuit will sense which terminals are connected to the line wires and latch the sensing circuit to those terminals to allow the GFCI to operate as designed to provide ground fault protection. The switching latching circuit 100 is located within the GFCI and, when power is applied, identifies which set of screw terminals is connected to the source of power and automatically connects that set of screw terminals to the correct set of input terminals of the GFCI receptacle.

Continuing with FIG. 8, the GFCI receptacle has a set of face terminals 102, 104 adapted to receive the blades of a plug, and a first set of screw terminals (A) 106, 108, and a second set of screw terminals (B) 110,112 located at the rear of the receptacle.

The switching latching circuit 100 includes two windings 114 and 116. Winding 114 is connected in series with a diode 118 and a resistor 120, and this series circuit is connected across rear mounted screw terminals (A) 106, 108. In a similar manner, winding 116 is connected in series with a diode 122 and a resistor 124, and this series circuit is connected across rear screw terminals (B) 110, 112. The windings 114, 116 can be continuous duty windings on two separate cores or they can be wound on a common core. The windings, together with sets of contacts can be either relays or solenoids with plunger activated contacts, and they can be either two separate relays or solenoids or a single solenoid or relay having two windings on a single core. When the relay (or solenoid) is a single relay having two separate windings, one winding urges the contacts in one direction and the other winding urges the contacts in a second direction. The relays can be of the latching type; and, if solenoids are used, permanent magnets can be use to hold the plunger in its extended or retracted position. Any relay or solenoid can be used to operate the contacts as disclosed below. For example, a single relay can have two separate windings on a common core and a plurality of contacts or two separate relays mechanically coupled to magnets or to a lever to move as one. In an embodiment which uses a solenoid having a single core and two windings, current through one winding will urge the plunger in one direction and current through the other winding will urge the plunger in a second direction. In another embodiment, a micro processor can be used to control the direction of the current through either of two coils or through a single coil. It is also understood that all or some of the components of the switching latching circuit 100 can be replaced with solid state devices such as switching transistors, flip flops and/or custom gate arrays, all or some of which can be on an IC chip.

In FIG. 8, for illustrative purposes, windings 114 and 116 are shown as being separated and coupled to separate groups of contacts. But, in the embodiment here disclosed, the winding 114,116 are located on the same core and are wound in opposite directions. Thus, when windings 116 is energized, the plunger, a single plunger which is common to both windings, causes the movable contacts 126,128, 136 and 138 to move to the left and make contact with the stationary contacts. Therefore, when solenoid 116 is energized, movable contact 126 engages contact 130, movable contact 128 engages contact 132, movable contact 136 engages contact 140 and movable contact 138 engages contact 142. In a similar manner, when solenoid 114 is energized, all of the movable contacts are urged to move to the right and movable contact 126 engages contact 132, movable contact 128 engages contact 134, movable contact 136 engages contact 142 and movable contact 138 engages contact 144. It is to be noted that stationary contact 132 is common to and is sequentially engaged by movable contacts 126 and 128; and stationary contact 142 common to and is sequentially engaged by movable contacts 136 and 138.

The plunger of the solenoid can be coupled to engage, for example, a permanent magnet or any other structure to hold the plunger in either its extended and/or retracted position. As will be explained below, when power is first applied to the GFCI receptacle, only one of the solenoids 114 or 116 is energized, and it is at this time that the rear set of terminals that are connected to the source of power are first connected to be the power receiving terminals of the GFCI receptacle.

In an embodiment that uses a single winding or mechanism, structure can be provided which disconnects the winding, either winding 114 or winding 116, from the screw contact which is coupled to the source of power. One such structure can be a low wattage resistor which will burn out, a fuse element which will open or the like. This will help to latch the mechanism in the selected position. In the situation where the switching latching circuit of the GFCI has two windings and the GFCI is removed from one location where the first winding was disconnected from the circuit and is installed in another location or it is removed and reinstalled at the same location, if power is applied to the second winding of mechanism, that second winding or mechanism will reposition the contacts to properly connect the source of power to the GFCI receptacle and then disconnect itself from the source of power. Thus, with two windings, it is possible to relocate the GFCI to another location and still properly connect the GFCI to a source of power without being concerned about the GFCI being reverse wired.

Resistors 120, 122 function to limit the current to the windings and diodes 118, 122 provide DC to the windings 114, 116. Obviously, if the windings are designed to operate with AC, the diodes can be eliminated. As noted above, the resistors should be sized to burn out or open after the connected winding is energized.

Figure 8A:
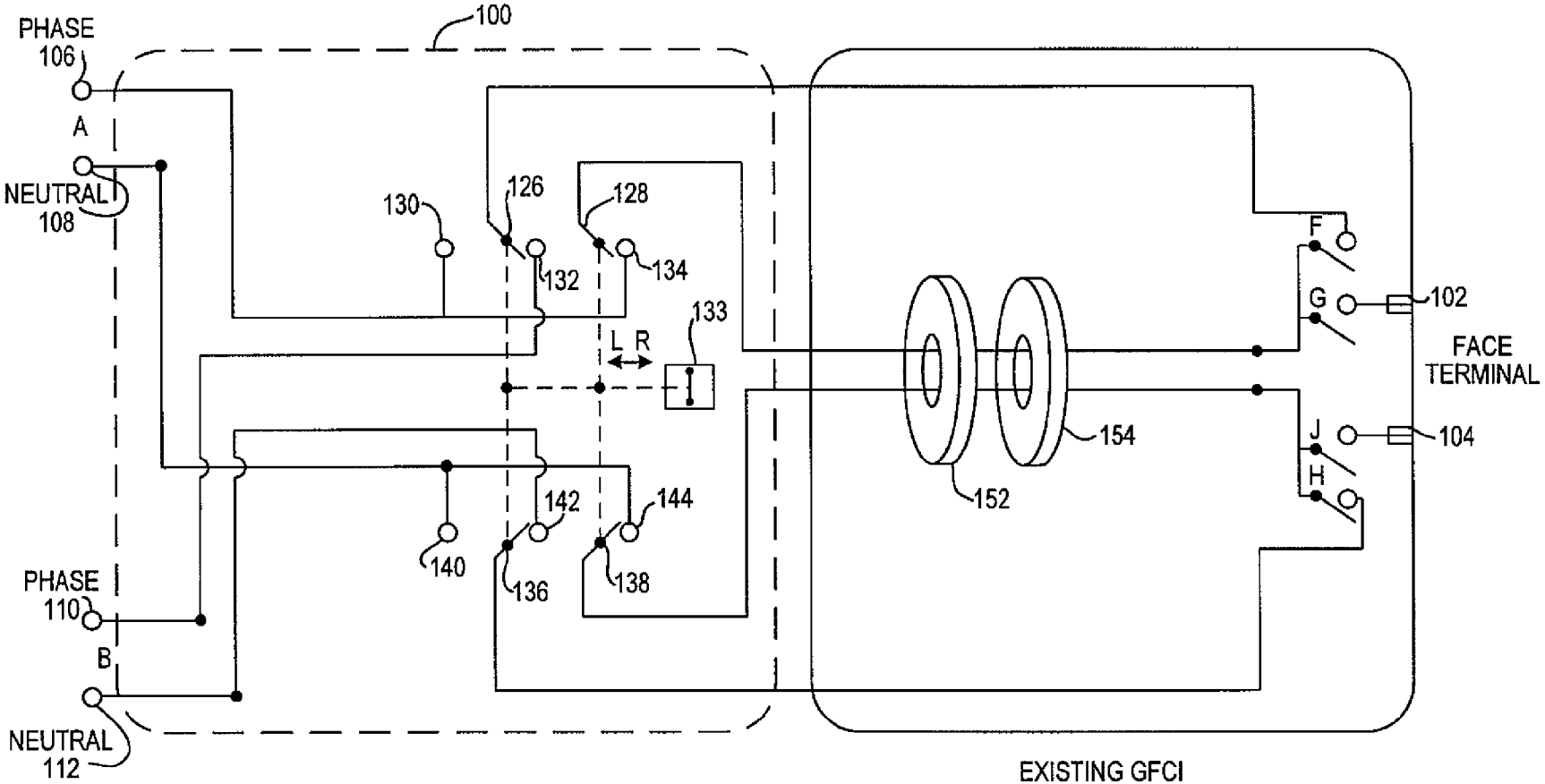
FIG. 8A is a schematic diagram of another embodiment of the sensing circuit and switching latching circuit for avoiding a reverse wiring condition.

Referring to FIG. 8A, there is shown an embodiment where the GFCI is manually operated to avoid a reverse wiring condition after the GFCI is installed and powered up. In this embodiment, a manually operated switch 133 which can be accessible from the face of the GFCI is connected to switch the movable contacts 126, 128, 136, 138 to either the left or the right to make contact with a first or a second set of stationary contacts. Initially, an installer wires a GFCI to line and phase conductors and then turns on the power to the GFCI. It is here noted that GFCI's are normally supplied to a purchaser in its tripped state. Therefore, after the power is turned on, the installer must press the reset button on the GFCI to connect the face terminals of the GFCI and the down stream circuits to the source of power. If, when the reset button is pressed the test button pops out, power will be present at the face terminals of the GFCI and at the circuits down stream of the GFCI, and the GFCI will be properly connected. However, if the test button does not pop out, and there is no power on the face terminals and the down stream circuit, then the GFCI is reverse wired. To correct this reverse wired condition, the installer simply operates the switch 133, which is accessible at the face of the GFCI, to its other position to properly connect the GFCI to the phase and neutral line and load conductors. Now, when the installer presses of the reset button, the test button will pop out and the face terminals of the GFCI and the down stream circuits will have power.

Still referring to FIG. 5A, when the switch 133 is move to the left, movable contacts 126,128, 136 and 138 move to the left and make contact with a first set of stationary contacts. Thus, when the switch is moved to the left, movable contact 126 engages contact 130, movable contact 128 engages contact 132, movable contact 136 engages contact 140 and movable contact 138 engages contact 142. In a similar manner, when the switch 133 is moved to the right, the movable contacts are urged to move to the right and movable contact 126 engages contact 132, movable contact 128 engages contact 134, movable contact 136 engages contact 142 and movable contact 138 engages contact 144. It is to be noted that stationary contact 132 is common to and is sequentially engaged by movable contacts 126 and 128; and stationary contact 142 common to and is sequentially engaged by movable contacts 136 and 138. Switch 133 can be a toggle type switch, a rotary switch, etc., which can be operated either directly by hand or with a tool.

In FIGS. 8 and 8A, differential transformers 152, 154 and contacts F, G, J and H are components normally found in a GFCI receptacle and their connections and operation are more fully shown and described in commonly owned U.S. Pat. No. 6,246,558 which is incorporated herein in its entirety by reference. When the GFCI receptacle is conducting, the contacts F, G, H and J are all closed. When the GFCI receptacle is tripped and, therefore, is not conducting, the contacts F, G, H and J are open.

The invention disclosed operates as follows. The GFCI receptacle having the switching latching circuit 100 allows either set of screw terminals, terminals A or B of the GFCI, to be connected to a source of power. The GFCI which is to be installed in a wall is supplied from the manufacturer, or from any supplier or seller in its tripped condition. That is, the contacts F, G, J and H in the GFCI are open. An installer mounts the GFCI, which is in its tripped condition, to a wall box and connects one set of wires to rear screw terminals (A) 106, 108; and the other set of wires to rear screw terminals (B) 110, 112. The installer need not know which of the wires being connected to the GFCI are the wires that are connected to the source of power and which set of wires are connected to down stream receptacles. After connecting the line and load wires to the GFCI receptacle, the installer energizes the circuits. It shall now be assumed that the wires connected to rear terminals (B) 110, 112 are connected to the source of power and the wires connected to the rear terminals (A) 106, 108 are connected to downstream receptacles.

With the embodiment of FIG. 8, upon energizing the circuits, a voltage is applied to terminals 110 and 112, winding 116 is energized and each of the movable contacts 136, 138, 126 and 128 are urged to move to the left. Thus, movable contacts 136, 138 now engage fixed contacts 140, 142 respectively; and movable contacts 126, 128 now engage fixed contacts 130, 132 respectively. The phase signal on terminal 110 is fed through contacts 132, 128 and now appears on open contacts F and G. The neutral signal on terminal 112 is fed through contacts 142, 138 and now appears on open contacts H and J. As noted above, contacts F, G, H and J are open because the GFCI is placed into commerce and provided to the installer with the contacts F, G, H and J in their open condition. At some time after power is supplied to the GFCI, the resistor 124 burns out or opens and winding 116 is disconnected from the source of power. In addition, the installer will press the reset button on the face of the GFCI, the contacts F, G, H and J in the GFCI will close and the phase signal on contact F will pass through contacts 126, 130 to rear terminal 106. At the same time, the voltage on contact G will be fed to the terminal 102 at the face of the GFCI. As with the phase signal, the neutral signal from terminal 112 will now pass through contacts H and be fed through contacts 136, 140 to rear terminal 108; at the same time the neutral signal will pass through contact J to the face terminal 104 of the receptacle.

We now assume that instead of making the connections notes above, the installer connects the GFCI so that power is applied to rear terminals (A) 106, 108, and that the load wires which are connected to down stream outlets are connected to rear terminals (B) 110, 112. Remembering that when the GFCI is installed in the wall box, it is in its tripped state and, when power is first applied, winding 114 is energized and all of the movable contacts 126, 128, 136 and 138 are urged to move to the right. The phase signal on terminal 106 is fed through contacts 134, 128 to open contacts F and G, and the neutral signal on terminal 108 is fed through contacts 144, 138 to open contacts H and J. At this time, because the GFCI has not been reset, contacts F, G, H and J are open and no power is present at the rear terminals (B) or at the face terminals 102, 104 of the GFCI receptacle. Also, after a short interval of time, resistor 120 burns out or opens to disconnect winding 114 from the source of power. Subsequently, when the installer pushes the reset button on the face of the GFCI, the contacts F, G, H and J in the GFCI close and phase power will flow through closed contact F, contacts 126 and 132 to terminal 110 of rear terminals B. At the same time, phase power will flow through contacts G to contact 102 of the face terminals. In a similar manner, closed contact H connects the neutral terminal 108 through closed contacts 136 and 142 to the neutral terminal 112 of rear terminals B; and closed contact J connects neutral terminal 112 to face terminal 104.

As noted above, with the embodiment of FIG. 8A, if the GFCI is reversed wired, the installer simply moves the switch 133 to its other position to eliminate the reverse wiring condition.

Figure 9:
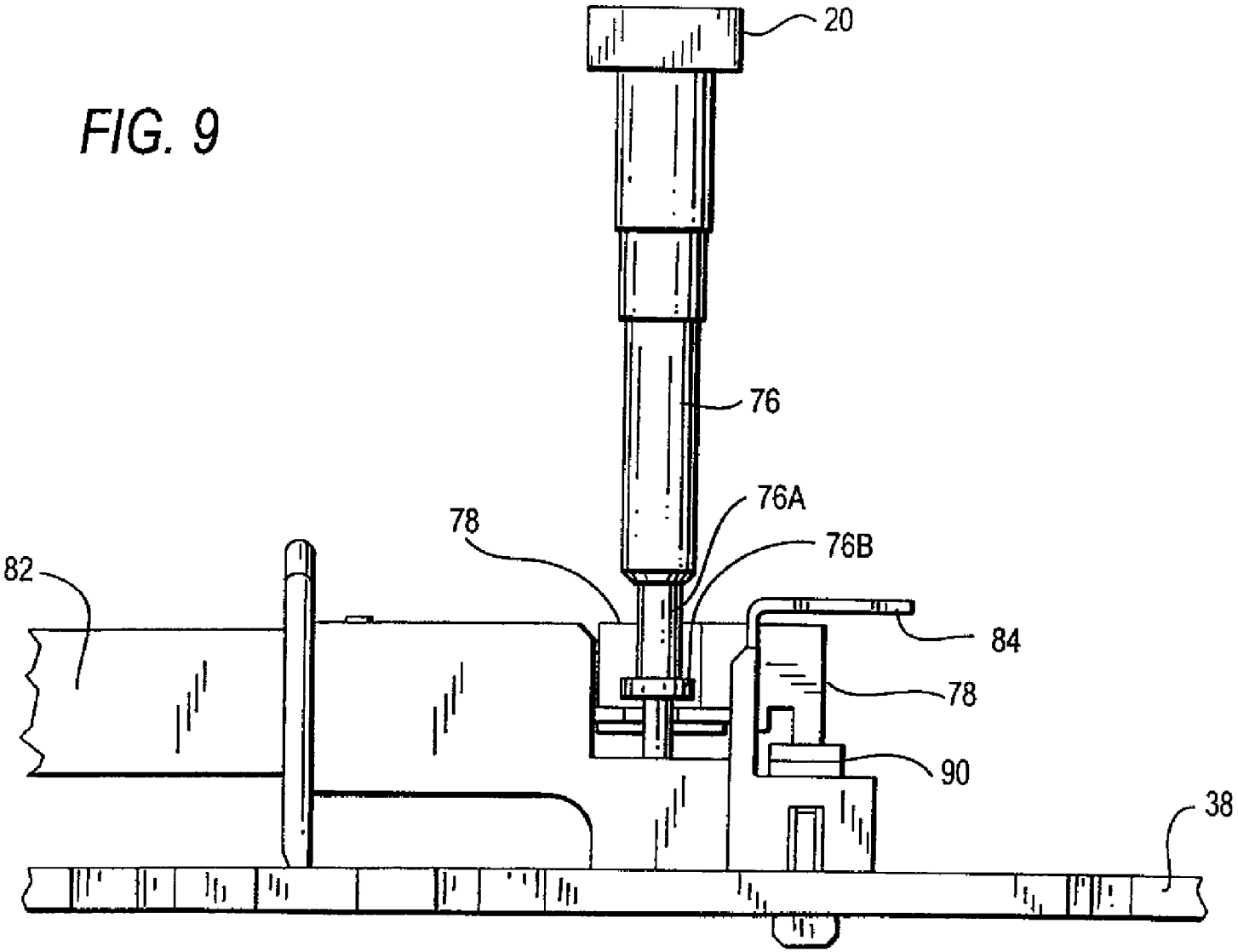
FIGS. 9-14 show the sequence of events when the device of the present invention is reset from a tripped state.

Referring to FIGS. 9-14, there is shown a sequence of how the GFCI is reset from a tripped condition. When the GFCI device is in a tripped condition, the line, load and face terminals are electrically isolated from each other because the movable bridges are not engaged to any of the terminals. Referring to FIG. 9 there is shown the positioning of the reset button 20, reset pin 76, reset pin lower portion 76A and disk 76B when the device is in the tripped condition. In the tripped condition, the lifter 78 positioned below the movable bridges (not shown) does not engage the movable bridges. Reset button 20 is in its fully up position. Latch 84 and lifter 78 are such that the openings of the latch 84 and the lifter 78 are misaligned not allowing disk 76B to go through the openings. Also a portion of lifter 78 is positioned directly above test arm 90 but does not engage test arm 90.

Figure 10:
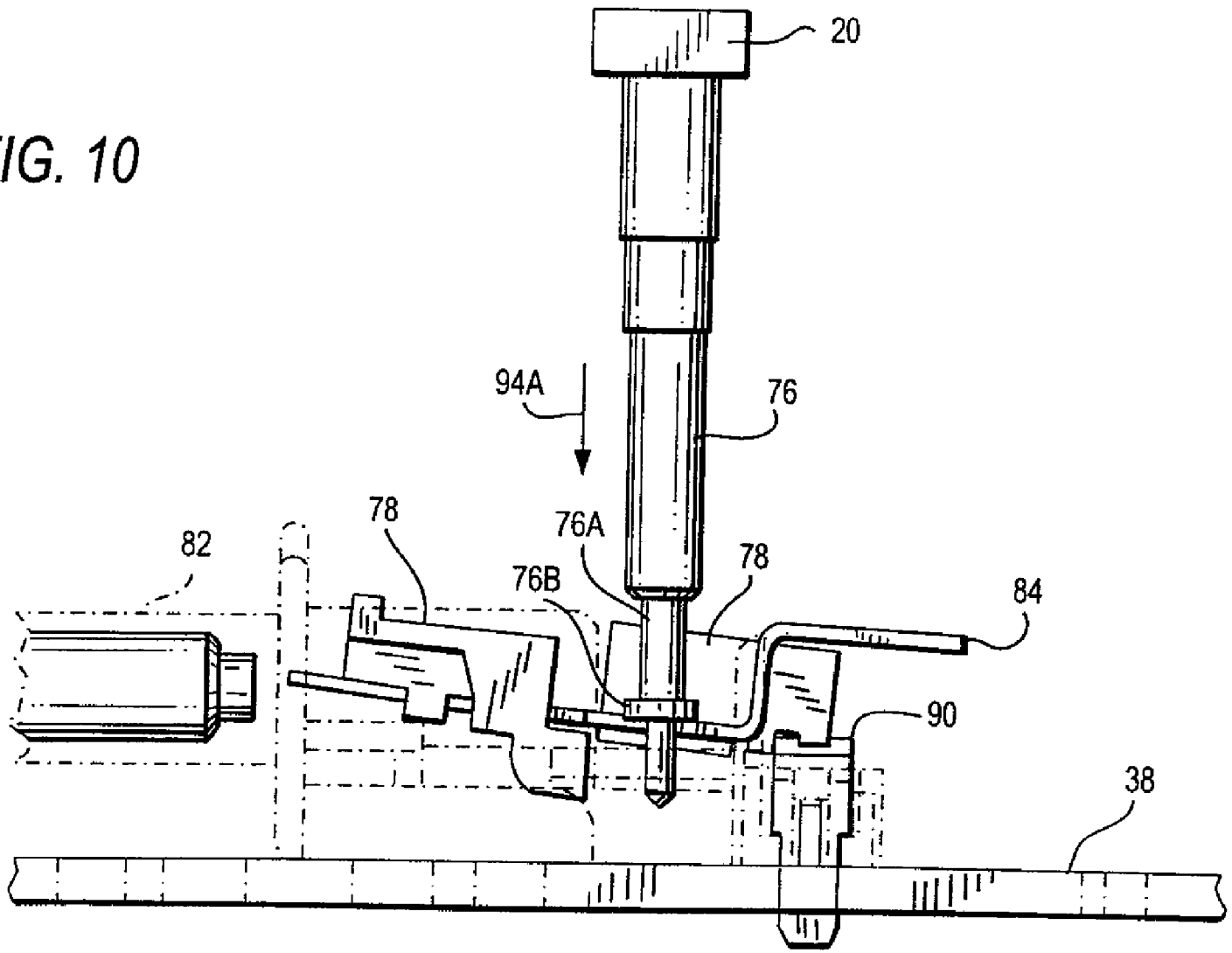

In FIG. 10, to initiate the resetting of the GFCI device, reset button 20 is depressed (in the direction shown by 94A) causing flange 76B to interfere with latch plate 84 as shown which causes lifter 78 to press down on test arm 90 of the mechanical switch. As a result, test arm 90 makes contact with test pin 92 (see FIG. 6).

Figure 11:
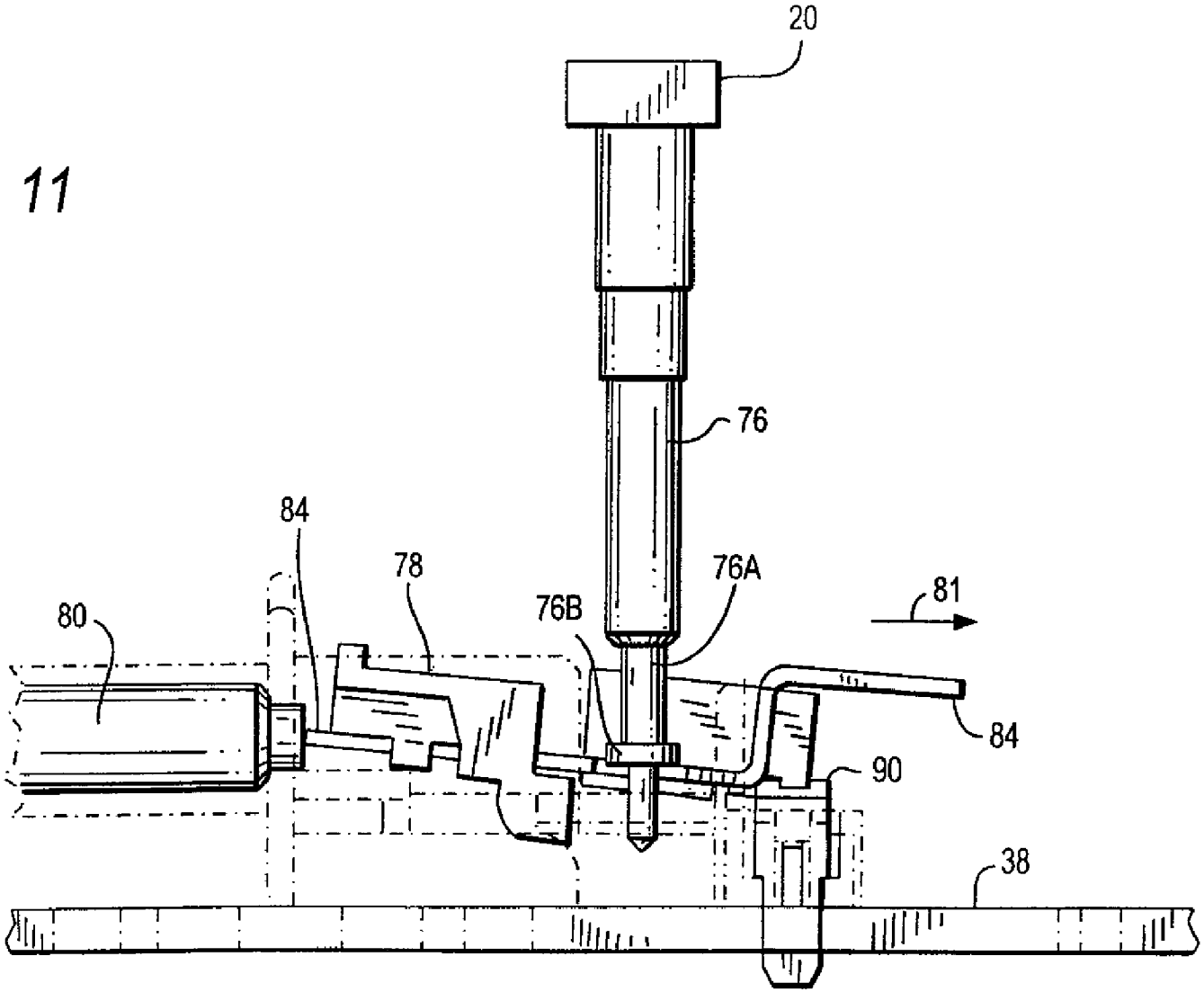

In FIG. 11, when test arm 90 makes contact with test pin 92, the sensing circuit is triggered as explained above, energizing the coil causing plunger 80 to be momentarily pulled into the bobbin 82 engaging latch plate 84 and more specifically pushing momentarily latch plate 84 in the direction shown by arrow 81.

Figure 12:
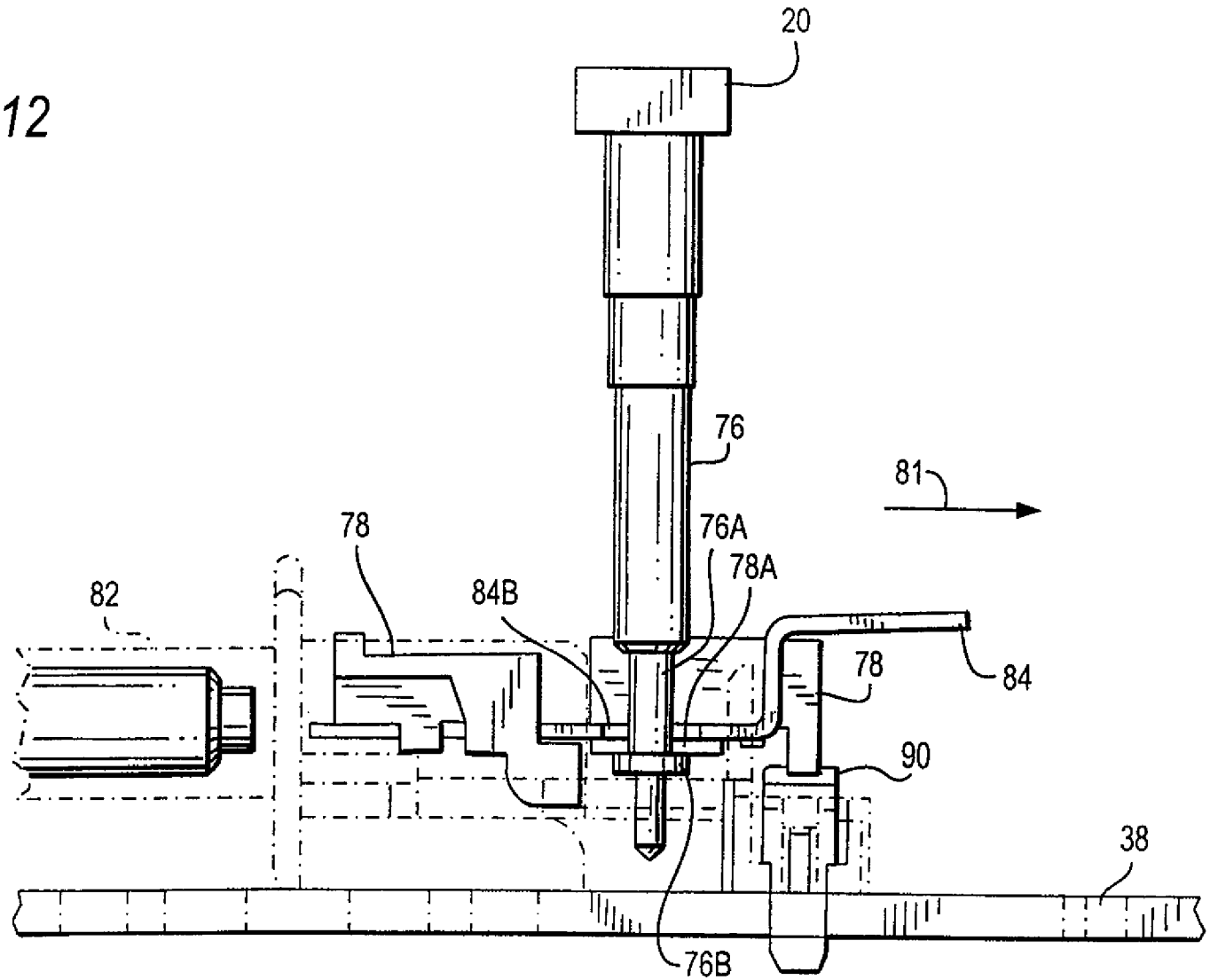

In FIG. 12, the latch plate, when pushed by plunger 80, slides along lifter 78 (in the direction shown by arrow 81) so as to align its opening with the lifter opening allowing flange 76B and part of lower reset pin portion 76A to extend through the openings 84B, 78A (see FIG. 7).

Figure 13:
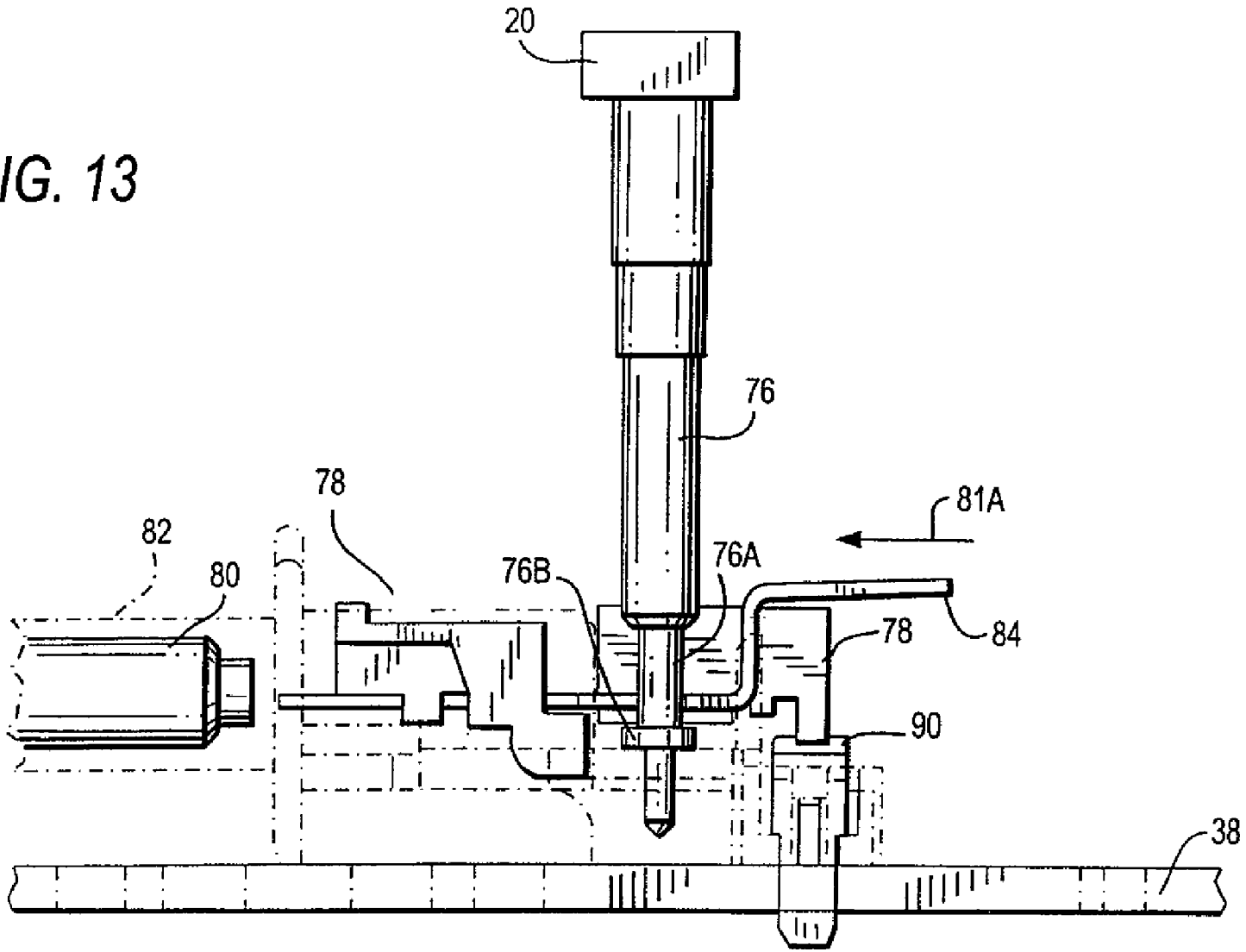
Figure 14:
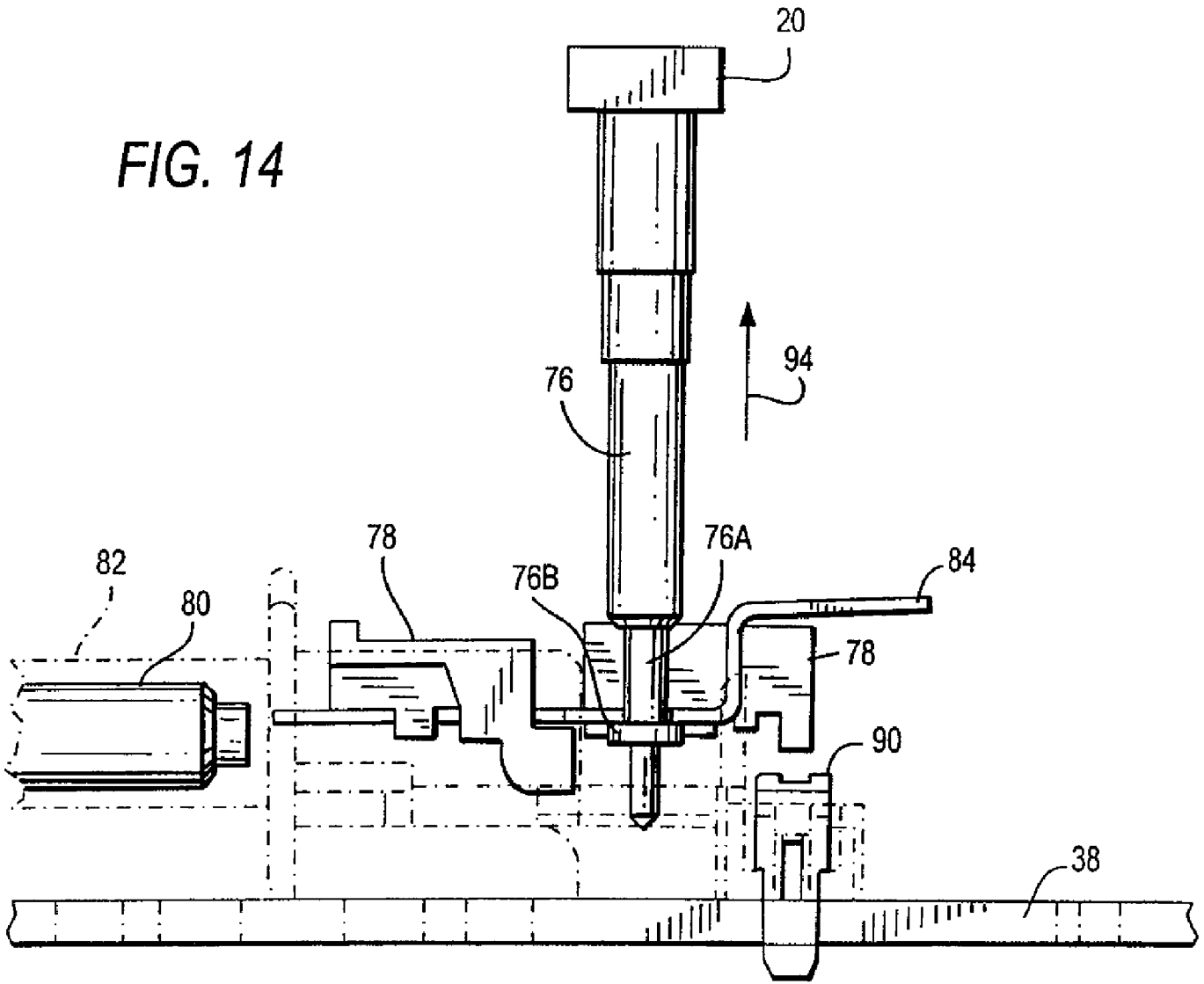

In FIG. 13, the latch plate then recoils back (in the direction shown by arrow 81A) and upon release of the reset button, test arm 90 also springs back disengaging from test pin 92. In FIG. 14, the recoiling of the latch plate 84 causes the opening 84B to once again be misaligned with opening 74A thus trapping flange 76B underneath the lifter 78 and latch assembly. When reset button is released the biasing of the reset pin 76 in concert with the trapped flange 76B raise the lifter and latch assembly causing the lifter (located underneath the movable bridges) to engage the movable bridges 66, 64. In particular, the connecting portions (66A, 64A) of the movable bridges 66 and 64 respectively are bent in the direction shown by arrow 65 (see FIG. 3 and corresponding discussion supra) resulting in the line terminals, load terminals and face terminals being electrically connected to each other. The GFCI is now in the reset mode meaning that the electrical contacts of the line, load and face terminals are all electrically connected to each other allowing power from the line terminal to be provided to the load and face terminals. The GFCI will remain in the reset mode until the sensing circuit detects a fault or the GFCI is tripped purposely by depressing the test button 22.

When the sensing circuit detects a condition such as a ground fault for a GFCI or other conditions (e.g., arc fault, immersion detection fault, appliance leakage fault, equipment leakage fault), the sensing circuit energizes the coil causing the plunger 80 to engage the latch 84 resulting in the latch opening 84B being aligned with the lifter opening 78A allowing the lower portion of the reset pin 76A and the disk 76B to escape from underneath the lifter causing the lifter to disengage from the double pole single throw switch contacts or movable bridges 64, 66 which, due to their biasing, move away from the face terminals contacts and load terminal contacts. As a result, the line, load and face terminals are electrically isolated from each other and thus the GFCI device is in a tripped state or condition (see FIG. 9).

Figure 15:
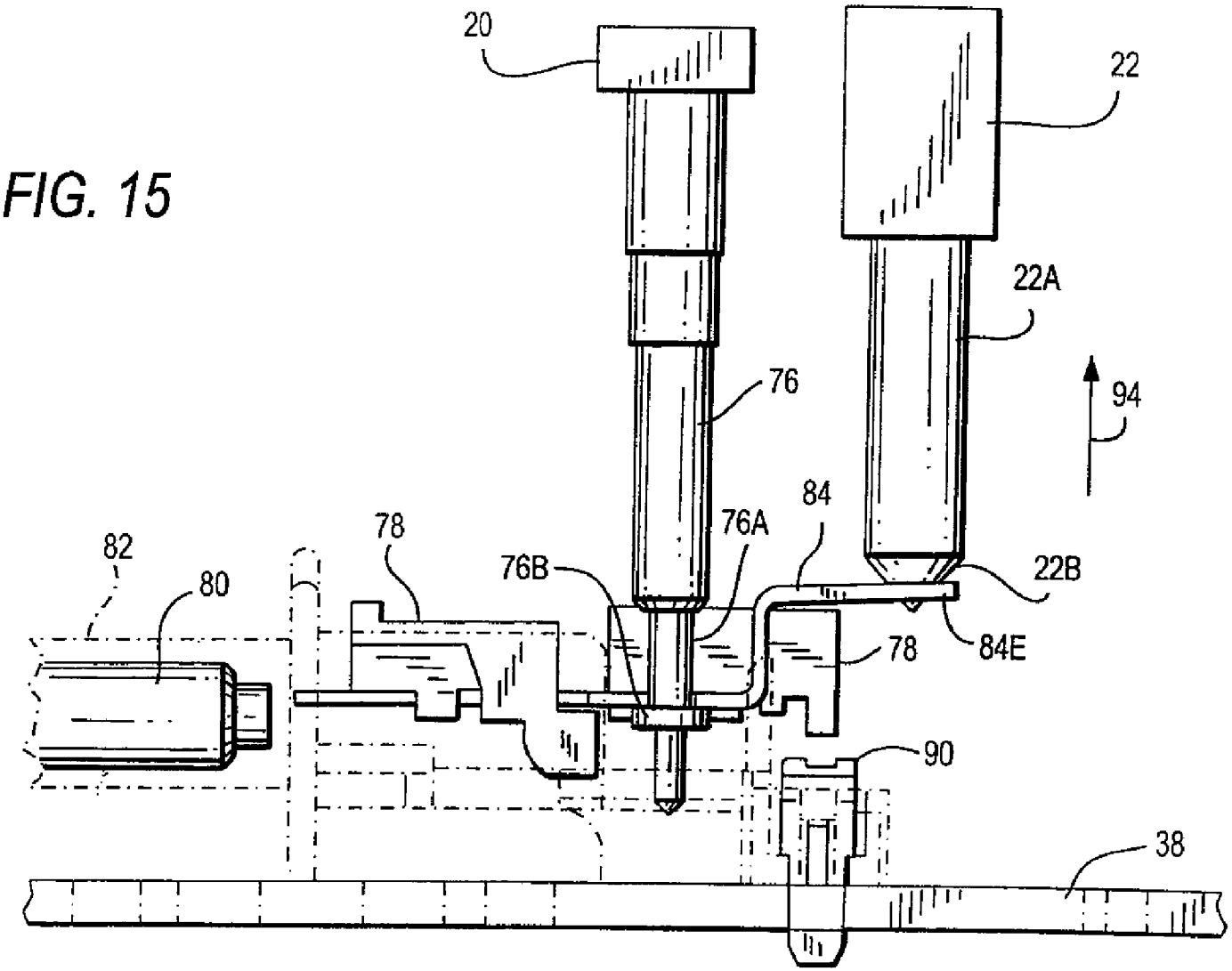
FIGS. 15-18 show the sequence of events when the device of the present invention is tripped while in a reset state.
Figure 18:
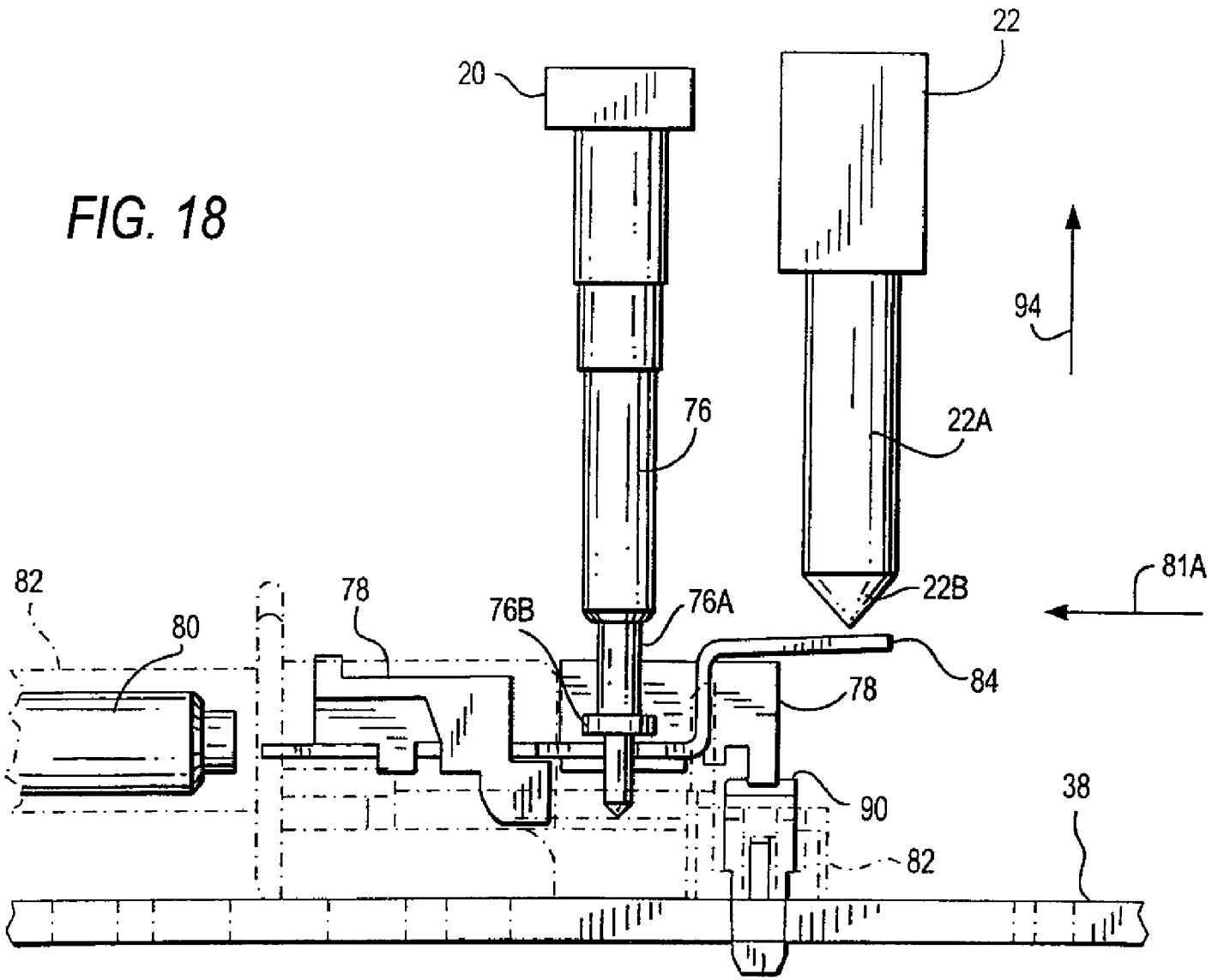

The GFCI device of the present invention can also enter the tripped state by pressing the test button 22. In FIGS. 15 18, there is illustrated a sequence of operation showing how the device can be tripped using the test button 22. In FIG. 15, while the device is in the reset mode, test button 22 is depressed. Test button 22 has test button pin portion 22A and cam end portion 22B connected thereto and is mechanically biased upward in the direction shown by arrow 94. The cam end portion 22B is preferably conically shaped so that when it engages with the hooked end 84E of latch plate 84 a cam action occurs due to the angle of the end portion of the test button pin 22A.

Figure 16:
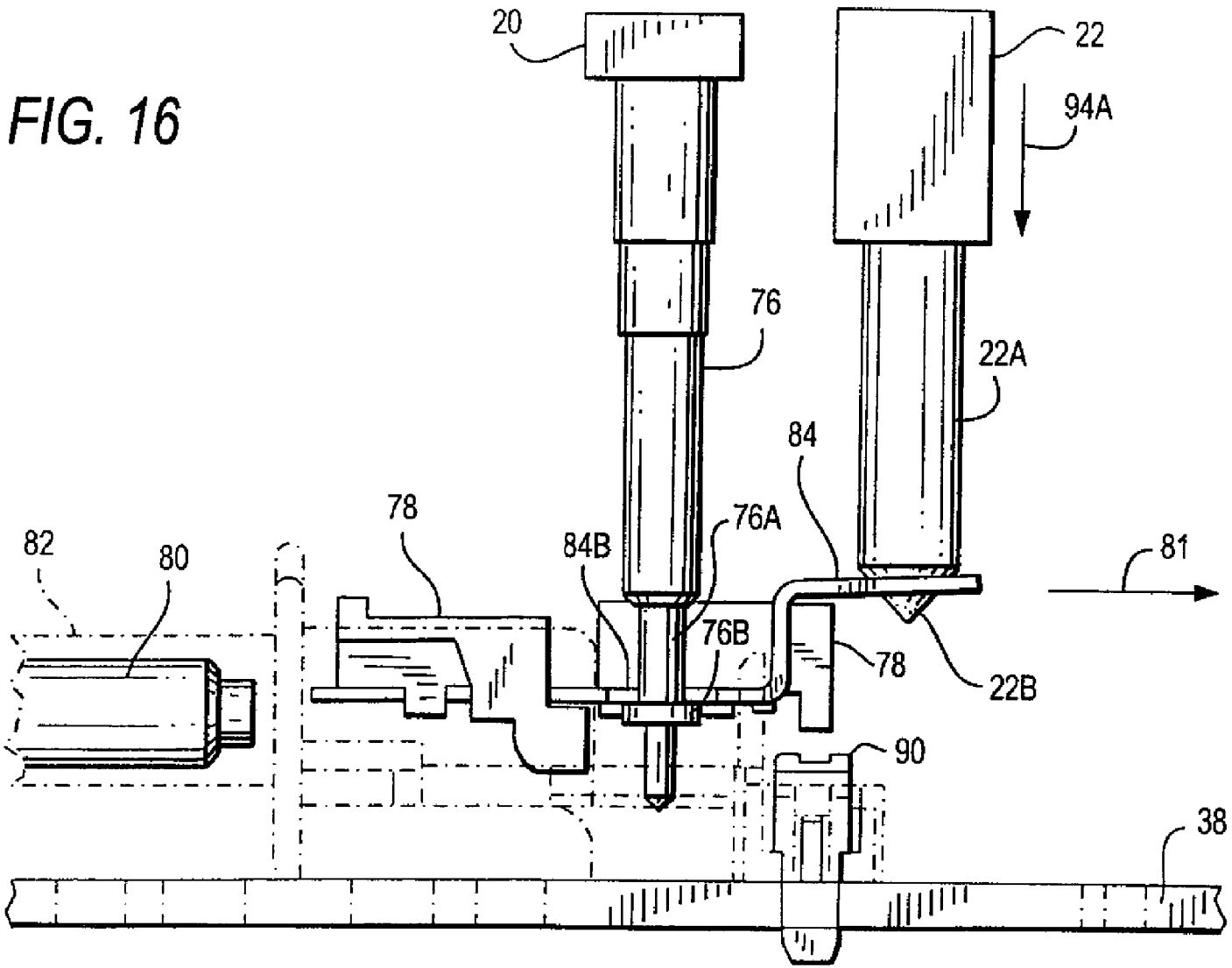

In FIG. 16, the cam action is the movement of latch plate 84 in the direction shown by arrow 81 as test button 22 is pushed down (direction shown by arrow 94A) causing latch plate opening 84B to be aligned with lifter opening 78A.

Figure 17:
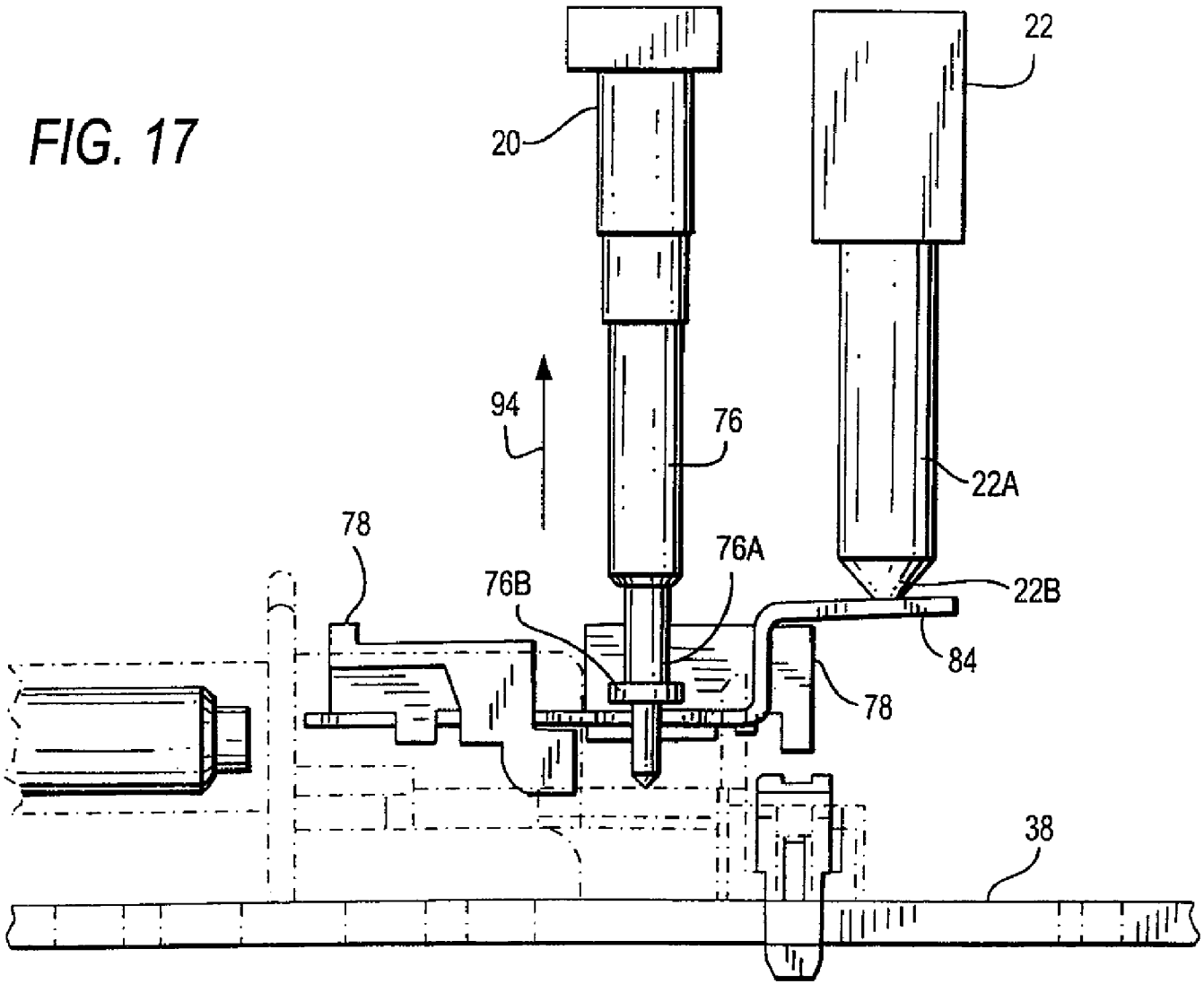

In FIG. 17, the alignment of the openings (78A, 84B) allows the lower portion of the reset pin 76A and the disk 76B to escape from underneath the lifter causing the lifter to disengage from the movable bridges 64, 66 which, due to their biasing, move away from the face terminals contacts and load terminal contacts (see FIG. 3). The test button 20 is now in a fully up position. As a result, the line, load and face terminals are electrically isolated from each other and thus the GFCI device is in a tripped state or condition (see FIG. 9). In FIG. 18, the test button 22 is released allowing its bias to move it upward (direction shown by arrow 94) and disengage from the hook portion 84E of latch plate 84. The latch plate recoils in the direction shown by arrow 81A thus causing the opening in the latch plate 84 to be misaligned with the opening of the lifter 78. The device is now in the tripped position. It should be noted that once the device of the present invention is in a tripped position, depressing the test button will not perform any function because at this point the latch 84 cannot be engaged by the angled end of the test button 22. The test button 22 will perform the trip function after the device has been reset.

The GFCI device of the present invention once in the tripped position will not be allowed to be reset (by pushing the reset button) if the circuit interrupting portion is non-operational; that is if any one or more of the components of the circuit interrupting portion is not operating properly, the device cannot be reset. Further, if the sensing circuit is not operating properly, the device can not be reset. The reset lockout mechanism of the present invention can be implemented in an affirmative manner where one or more components specifically designed for a reset lockout function are arranged so as to prevent the device from being reset if the circuit interrupting portion or if the sensing circuit are not operating properly. The reset lockout mechanism can also be implemented in a passive manner where the device will not enter the reset mode if any one or more of the components of the sensing circuit or if any one or more of the components of the circuit interrupting portion is not operating properly; this passive reset lockout approach is implemented in the present invention. For example, if anyone of the following components is not operating properly or has a malfunction—i.e., the coil/plunger assembly (82,80) or the latch plate/lifter assembly (84,78) or the reset button/reset pin (22,76) the device cannot be reset. Further if the test arm (90) or test pin (92) is not operating properly, the device cannot be reset.

It should be noted that the circuit interrupting device of the present invention has a trip portion that operates independently of the circuit interrupting portion so that in the event the circuit interrupting portion becomes non-operational the device can still be tripped. Preferably, the trip portion is manually activated as discussed above (by pushing test button 22) and uses mechanical components to break one or more conductive paths. However, the trip portion may use electrical circuitry and/or electromechanical components to break either the phase or neutral conductive path or both paths.

Although the components used during circuit interrupting and device reset operations are electromechanical in nature, the present application also contemplates using electrical components, such as solid state switches and supporting circuitry, as well as other types of components capable or making and breaking electrical continuity in the conductive path.

It should also be noted that the circuit interrupting device of the present invention can be part of a system comprising one or more circuits routed through a house, for example, or through any other well known structure. Thus, the system of the present invention is configured with electricity conducting media (e.g., electrical wire for carrying electrical current) that form at least one circuit comprising at least one circuit interrupting device of the present invention, electrical devices, electrical systems and/or components; that is, electrical components, electrical devices and or systems can be interconnected with electrical wiring forming a circuit which also includes the circuit interrupting device of the present invention. The formed circuit is the system of the present invention to which electrical power is provided. The system of the present invention can thus protect its components, systems, or electrical devices by disconnecting them from power if the circuit interrupting device has detected a fault (or predetermined condition) from any one of them. In one embodiment, the circuit interrupting device used in the system can be a GFCI.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed:

1. A circuit interrupting device comprising:

a housing;

a first set of terminals disposed at least partially within said housing and capable of being line terminals to receive electricity from a power input line, or being load terminals to feed electricity to a load;

a second set of terminals disposed at least partially within said housing to feed electricity to a load when said first set of terminals is connected as line terminals, or of being line terminals when said first set of terminals is connected as load terminals;

a set of electrical conductors disposed within said housing for electrically connecting the first set of terminals and the second set of terminals together;

a circuit interrupter disposed within said housing and configured to cause electrical discontinuity in said set of electrical conductors between said first set of terminals and said second set of terminals wherein said circuit interrupter is disposed between said first set of terminals and said second set of terminals;

switching latching circuit disposed within said housing coupled to identify which of said first and said second set of terminals is connected as line terminals and to selectively connect the said first set of terminals as line terminals to the circuit interrupting device and connect said second set of terminals to the circuit interrupting device as the load terminals when said power input line is coupled to said first set of terminals and to selectively connect said second set of terminals as line terminals to the circuit interrupting device and connect said first set of terminals to the circuit interrupting device as the load terminals when said power input line is coupled to said second set of terminals wherein said switching latching circuit comprises a first latching member having a coil and fixed and movable contacts where said coil is coupled across the first set of terminals and said contacts are latchable, and a second latching member having a coil and fixed and movable contacts where said coil is coupled across the second set of terminals and said contacts are latchable; and a reset circuit disposed at least partially within said housing and configured to establish electrical continuity between said first set of terminals and said second set of terminals.

2. The circuit interrupting device of claim 1 wherein said circuit interrupting circuit further comprises bridge contacts.

3. The circuit interrupting device of claim 1 wherein said circuit interrupting circuit further comprises double pole single throw switch contacts.

4. The circuit interrupting device of claim 1 wherein the coil of said first latching member is coupled in series with a fusible member; and the coil of said second latching member is coupled in series with a fusible member.

5. The circuit interrupting device of claim 4 wherein the fusible member of said first latching member is configured to become non-conductive and disconnect the coil from across the first set of terminals when the first set of terminals is connected to receive electricity from a line.

6. The circuit interrupting device of claim 4 wherein the fusible member of said second latching member is configured to become non-conductive and disconnect the coil from across the second set of terminals when the second set of terminals is connected to receive electricity from a line.

7. The circuit interrupting device of claim 5 wherein, when the first set of terminals is connected to receive electricity from a line, the movable contacts of said first and second latching members are urged to a first position.

8. The circuit interrupting device of claim 6 wherein, when the second set of terminals is connected to receive electricity from a line, the movable contacts of said first and second latching members are urged to a second position.

9. The circuit interrupting device of claim 1 wherein said switching latching circuit further comprises:

a first relay having a coil and fixed and movable contacts where said coil is coupled across the first set of terminals and said contacts; and a second relay having a coil and fixed and movable contacts where said coil is coupled across the second set of terminals and said contacts.

10. The circuit interrupting device of claim 9 wherein said first and second relays are latchable relays.

11. The circuit interrupting device of claim 10 wherein said first and second relays are AC relays.

12. The circuit interrupting device of claim 10 wherein the first and second relays are DC relays.

13. The circuit interrupting device of claim 1 wherein said switching latching circuit comprises solid state devices.

14. The circuit interrupting device of claim 1 wherein said switching latching circuit comprises at least one manually operated device.

15. A circuit interrupting device comprising:

a housing;

a first set of terminals comprising a phase terminal and a neutral terminal disposed at least partially within said housing and capable of being line terminals to receive electricity from a power input line, or being load terminals to feed electricity to a load;

a second set of terminals comprising a phase terminal and a neutral terminal disposed at least partially within said housing to feed electricity to a load when said first set of terminals is connected as line terminals, or of being line terminals when said first set of terminals is connected as load terminals;

at least one set of face terminals capable of being electrically connected to at least one user accessible plug;

a set of electrical conductors disposed within said housing for electrically connecting the first set of terminals, the second set of terminals and the face terminals together;

a circuit interrupter disposed within said housing and configured to cause electrical discontinuity in said set of electrical conductors between said first set of terminals, said second set of terminals and said at least one set of face terminals wherein said circuit interrupter is disposed between said first set of terminals and said second set of terminals;

switching circuit disposed within said housing coupled to connect either the first or second set of terminals to be line terminals for the circuit interrupting device and the other set of terminals to be load terminals for the circuit interrupting device wherein said switching circuit is configured to switch to provide a line side power connection to either said first set of contacts or said second set of contacts based upon whether a power input line is coupled to said first set of terminals or said second set of terminals wherein said switching latching circuit comprises a first latching member having a coil and fixed and movable contacts where said coil is coupled across the first set of terminals and said contacts are latchable, and a second latching member having a coil and fixed and movable contacts where said coil is coupled across the second set of terminals and said contacts are latchable; and a reset circuit disposed at least partially within said housing and configured to establish electrical continuity between said first set of terminals, said second set of terminals and said at least one set of face terminals.

16. The circuit interrupting device of claim 15 wherein the switching circuit is manually operated.

17. The circuit interrupting device of claim 16 wherein the switching circuit is accusable from the face of the housing.

* * * * *